US005993573A

United States Patent [19]

Selepack et al.

[11] Patent Number: 5,993,573

[45] **Date of Patent: *Nov. 30, 1999**

[54] CONTINUOUSLY ANNEALED ALUMINUM ALLOYS AND PROCESS FOR MAKING SAME

[75] Inventors: Mark S. Selepack, Arvada, Colo.; Theodore E. Blakely, San Antonio, Tex.

[73] Assignee: Golden Aluminum Company, Golden, Colo.

[ * ] Notice: This patent is subject to a terminal disclaimer.

[21] Appl. No.: 08/869,817

[22] Filed: Jun. 4, 1997

[51] Int. Cl.[6] ..... C22F 1/04

[52] U.S. Cl. ..... 148/551; 148/552; 148/692; 148/693; 148/696; 164/476

[58] Field of Search ..... 148/551, 552, 148/692, 693, 439, 688, 696, 417, 440; 164/459, 462, 476, 477

[56] References Cited

U.S. PATENT DOCUMENTS

| | | | |
|---|---|---|---|
| 3,787,248 | 1/1974 | Setzer et al. . | |
| 3,930,895 | 1/1976 | Moser et al. . | |
| 4,028,141 | 6/1977 | Chia et al. . | |
| 4,111,721 | 9/1978 | Hitchler et al. . | |
| 4,151,013 | 4/1979 | Thompson et al. . | |
| 4,151,896 | 5/1979 | Nicoud et al. . | |
| 4,235,646 | 11/1980 | Neufeld et al. . | |
| 4,238,248 | 12/1980 | Gyöngyös et al. . | |
| 4,260,419 | 4/1981 | Robertson | 75/142 |
| 4,269,632 | 5/1981 | Robertson et al. . | |
| 4,282,044 | 8/1981 | Robertson et al. | 148/2 |
| 4,318,755 | 3/1982 | Jeffrey et al. . | |
| 4,334,935 | 6/1982 | Morris . | |
| 4,407,679 | 10/1983 | Manzonelli et al. . | |
| 4,411,707 | 10/1983 | Brennecke et al. . | |
| 4,424,084 | 1/1984 | Chisholm | 148/417 |
| 4,441,933 | 4/1984 | Boutin et al. . | |
| 4,498,523 | 2/1985 | Bowman et al. | 164/477 |
| 4,517,034 | 5/1985 | Merchant et al. | 148/439 |
| 4,526,625 | 7/1985 | Merchant et al. . | |
| 4,582,541 | 4/1986 | Dean et al. . | |
| 4,589,932 | 5/1986 | Park . | |
| 4,605,448 | 8/1986 | Baba et al. . | |
| 4,614,224 | 9/1986 | Jeffrey et al. | 164/476 |
| 4,614,552 | 9/1986 | Fortin et al. | 148/417 |
| 4,626,294 | 12/1986 | Sanders, Jr. . | |
| 4,637,842 | 1/1987 | Jeffrey et al. . | |
| 4,645,544 | 2/1987 | Baba et al. . | |
| 4,718,948 | 1/1988 | Komatsubara et al. . | |
| 4,753,685 | 6/1988 | Usui et al. . | |
| 4,791,798 | 12/1988 | Manabe et al. | 72/202 |
| 4,855,107 | 8/1989 | Teirlinck et al. | 420/546 |
| 4,861,388 | 8/1989 | Fortin et al. . | |
| 4,872,921 | 10/1989 | Teirlinck . | |

(List continued on next page.)

FOREIGN PATENT DOCUMENTS

| | | | |
|---|---|---|---|
| 0 485 949 A1 | 5/1992 | European Pat. Off. . | |
| 93304424 | 6/1993 | European Pat. Off. | C22F 1/04 |
| 93304426 | 6/1993 | European Pat. Off. | C22F 1/04 |
| 4-221036 | 8/1992 | Japan . | |
| 4-224651 | 12/1992 | Japan . | |
| WO 90/10091 | 9/1990 | WIPO . | |
| WO 96/28582 | 9/1996 | WIPO | C22F 1/04 |

OTHER PUBLICATIONS

Don McAuliffe, "Production of Continuous Cast Can Body Stock", Paper presented at AIME Meeting, Feb. 27, 1989, 7 pages.

*Primary Examiner*—George Wyszomierski
*Attorney, Agent, or Firm*—Sheridan Ross P.C.

[57] ABSTRACT

The present invention provides an improved process for continuously casting aluminum alloys and improved aluminum alloy compositions. The process includes the steps of (a) heating the cast strip before, during or after hot rolling to a temperature in excess of the output temperature of the cast strip from the chill blocks and (b) stabilization or back annealing in an induction heater of cold rolled strip produced from the cast strip. The alloy composition has a relatively low magnesium content yet possesses superior strength properties.

35 Claims, 6 Drawing Sheets

U.S. PATENT DOCUMENTS

| | | | |
|---|---|---|---|
| 4,929,285 | 5/1990 | Zaidi . | |
| 4,976,790 | 12/1990 | McAuliffe et al. . | |
| 4,988,394 | 1/1991 | Cho . | |
| 5,061,327 | 10/1991 | Denzer et al. . | |
| 5,089,490 | 2/1992 | Huu . | |
| 5,104,459 | 4/1992 | Chen et al. . | |
| 5,104,465 | 4/1992 | McAuliffe et al. | 148/439 |
| 5,106,429 | 4/1992 | McAuliffe et al. . | |
| 5,110,545 | 5/1992 | McAuliffe et al. | 420/534 |
| 5,133,402 | 7/1992 | Ross | 164/431 |
| 5,156,683 | 10/1992 | Ross | 118/620 |
| 5,192,378 | 3/1993 | Doherty et al. | 148/691 |
| 5,356,495 | 10/1994 | Wyatt-Mair et al. | 148/551 |
| 5,469,912 | 11/1995 | McAuliffe | 164/476 |
| 5,470,405 | 11/1995 | Wyatt-Mair et al. | 148/551 |
| 5,496,423 | 3/1996 | Wyatt-Mair et al. | 148/551 |
| 5,514,228 | 5/1996 | Wyatt-Mair et al. | 148/551 |
| 5,681,405 | 10/1997 | Newton et al. | 480/534 |
| 5,833,775 | 11/1998 | Newton et al. | 148/551 |

CONTINUOUSLY ANNEALED ALUMINUM ALLOYS AND PROCESS FOR MAKING SAME

FIELD OF THE INVENTION

The present invention relates generally to aluminum alloy sheet and methods for making aluminum alloy sheet and specifically to aluminum alloy sheet and methods for making aluminum alloy sheet for use in forming drawn and ironed container bodies.

BACKGROUND OF THE INVENTION

Aluminum beverage containers are generally made in two pieces, one piece forming the container sidewalls and bottom (referred to herein as a "container body") and a second piece forming a container top. Container bodies are formed by methods well known in the art. Generally, the container body is fabricated by forming a cup from a circular blank aluminum sheet (i.e., body stock) and then extending and thinning the sidewalls by passing the cup through a series of dies having progressively smaller bore sizes. This process is referred to as "drawing and ironing" the container body. The ends of the container are formed from end stock and attached to the container body. The tab on the upper container end that is used to provide an opening to dispense the contents of the container is formed from tab stock.

Aluminum alloy sheet is most commonly produced by an ingot casting process. In the process, the aluminum alloy material is initially cast into an ingot, for example, having a thickness ranging from about 20 to about 30 inches. The ingot is then homogenized by heating to an elevated temperature, which is typically 1075° F. to 1150° F., for an extended period of time, such as from about 6 to about 24 hours. "Homogenization" refers to a process whereby ingots are raised to temperatures near the solidus temperature and held at that temperature for varying lengths of time. Homogenization reduces microsegregation by promoting diffusion of solute atoms within the grains of aluminum and improves workability. Homogenization does not alter the crystal structure of the ingot. The homogenized ingot is then hot rolled in a series of passes to reduce the thickness of the ingot. The hot rolled sheet is then cold rolled to the desired final gauge.

Although ingot casting is a common technique for producing aluminum alloy sheet, a highly advantageous method for producing aluminum alloy sheet is by continuously casting molten metal. In a continuous casting process, molten metal is continuously cast directly into a relatively long, thin slab and the cast slab is then hot rolled and cold rolled to produce a finished product.

Some alloys are not readily continuously cast into an aluminum sheet that is suitable for forming operations, especially for making drawn and ironed container bodies. By way of example, some alloys have striated grain structures which lead to a number of problems. During fabrication, the aluminum alloy sheet produced from such alloys can generate unacceptably high amounts of fine particles, which cause a significant increase in the rate of wear to fabricating equipment. Striated grains further cause a high degree of variability in physical properties across a given sheet and among coils of sheets. Other alloys have a low degree of formability, an unacceptably high earing and/or undesirable strength properties.

It would be desirable to have a continuous aluminum casting process in which the aluminum alloy sheet can be readily fabricated into desired objects. It would be advantageous to have a continuous casting process in which the aluminum alloy sheet has an equiaxed as opposed to a striated grain structure. It would be advantageous to have an aluminum alloy sheet that generates a low amount of finely sized particles during fabrication. It would be advantageous to have an aluminum alloy sheet that has a high degree of formability, low earing and high strength.

SUMMARY OF THE INVENTION

These and other needs are addressed by the process and alloy compositions of the present invention. An induction heater is used in a stabilization or back anneal to impart desired mechanical properties to the aluminum alloy sheet. The method includes the following steps:

(a) continuously casting an aluminum alloy melt to form a cast strip;

(b) hot rolling the cast strip to form a hot rolled strip;

(c) cold rolling the hot rolled strip to form a cold rolled strip; and (d) annealing the cold rolled strip in an induction furnace to form aluminum alloy sheet.

The time and temperature of the annealing step (d) determines the degree of uniformity of the final properties of the aluminum alloy sheet. Preferably, the annealing step is conducted at a temperature ranging from about 148 to about 287° C. for a time ranging from about 2 to about 30 seconds.

It has been discovered that induction heaters in a stabilizing or back anneal can provide aluminum alloy sheet having more uniform mechanical properties throughout the coil. The induction furnace can be superior to conventional furnaces in annealing aluminum alloys because the induction furnace more uniformly heats the strip/coil. Radiant furnaces place the strip in a heated atmosphere and rely on thermal transfer to anneal the entire cross-section of the strip/coil, which can lead to more exposure of the exterior portions of the strip/coil to heat and less exposure of the middle portion of the strip/coil. In contrast, induction furnaces use electromagnetic energy to heat the strip substantially uniformly throughout the strip's cross-section and along the length of the strip. Accordingly, induction heaters provide for more uniform mechanical properties than radiant heaters.

In one process configuration, a heater is placed in front of the last hot mill stand to cause the cast strip or a partially hot rolled strip (collectively referred to as the "unheated strip") to self-anneal (i.e., recrystallize) after the heated strip cools (e.g., after hot rolling is completed) and reduce the load on each of the hot mill stands, thereby permitting greater reductions in the hot mill. "Recrystallization" refers to the production of a new grain structure without a phase change through heating of the strip. The increased reductions can eliminate one or more cold mill passes. Preferably, the heater increases the heater input temperature of the unheated strip by at least about 20° F. (i.e., about 6° C.) and more preferably by an amount ranging from about 50 (i.e., about 10° C.) to about 80° F. (i.e., about 27° C.). The heating step is preferably performed in a continuous as opposed to a batch heater. Preferable continuous heaters include solenoidal heaters, induction heaters, infrared heaters, and gas-fired heaters with solenoidal heaters being most preferred. Such heaters are a cost effective means for achieving the relatively high annealing temperatures desired in the heating step.

The heating step can be conducted before or during the hot rolling step. The heater can be located before the first hot mill stand or between hot mill stands. Multiple heaters can be located in multiple locations before the last hot mill stand. There is commonly no hot mill anneal when a heater is employed.

The aforementioned method can be used to fabricate tab stock or body stock depending upon the process steps and alloys employed.

For tab stock, the alloy preferably has the following composition:

(i) from about 3.5 to about 4.9% by weight magnesium, (ii) from about 0.05 to about 0.50% by weight manganese, (iii) from about 0.05 to about 0.15% by weight copper, (iv) from about 0.05 to about 0.35% by weight iron, and (v) from about 0.05 to about 0.20% by weight silicon.

The balance of the alloy is aluminum and no more than 0.05% by weight incidental additional materials and impurities. The specific process to fabricate the tab stock includes the steps of:

(a) continuously casting an aluminum alloy melt to form a cast strip;

(b) heating the cast strip to form a heated strip;

(c) hot rolling the heated strip to form a hot rolled strip wherein the hot rolled strip is preferably not subjected to an annealing step;

(d) cold rolling the hot rolled strip to form a cold rolled strip of the final desired gauge; and (e) stabilization or back annealing (hereinafter collectively referred to as "stabilization annealing") of the cold rolled strip in an induction furnace to form aluminum alloy sheet.

The tab stock can have particularly attractive properties. By way of example, the aluminum alloy sheet of the present invention can have an as-rolled yield strength of at least about 41 ksi, an as-rolled tensile strength of at least about 49 ksi, an elongation at break of at least about 3%, and a tab strength of at least about 5 pounds.

For body stock, the alloy preferably has the following composition:

(i) from about 0.9 to about 1.5% by weight magnesium, (ii) from about 0.8 to about 1.2% by weight manganese, (iii) no more than about 0.50% by weight copper, (iv) no more than about 0.60% by weight iron, and (v) no more than about 0.50% by weight silicon.

The balance of the alloy is aluminum and no more than 0.05% by weight incidental additional materials and impurities. The specific process to fabricate the tab stock includes the steps of:

(a) continuously casting an aluminum alloy melt to form a cast strip;

(b) heating the cast strip to form a heated strip;

(c) hot rolling the heated strip to form a hot rolled strip wherein the hot rolled strip is preferably not subjected to a hot mill annealing step;

(d) partially cold rolling the hot rolled strip to form a partially cold rolled strip of an intermediate gauge;

(e) intermediate annealing of the partially cold rolled strip to form an intermediate annealed cold rolled strip;

(f) further cold rolling the intermediate annealed cold rolled strip to form a cold rolled strip of the desired final gauge; and (g) stabilization annealing of the cold rolled strip in an induction furnace to form aluminum alloy sheet.

The body stock has particularly attractive properties. The aluminum alloy sheet can have an as-rolled yield strength of at least about 38 ksi, an as-rolled tensile strength of at least about 42.5 ksi, an earing of less than about 1.8%, and an elongation at break of at least about 3%. Surprisingly, strip that is intermediate annealed with an induction heater can have as-rolled yield and tensile strengths that are from about 3 to about 5 ksi more than that of strip that is intermediate annealed with a batch heater.

Container bodies produced from the body stock can have superior properties. Container bodies produced from aluminum alloy sheet can have a buckle strength of at least about 90 psi and a column strength about 180 psi.

DETAILED DESCRIPTION

Introduction

Figure 1:
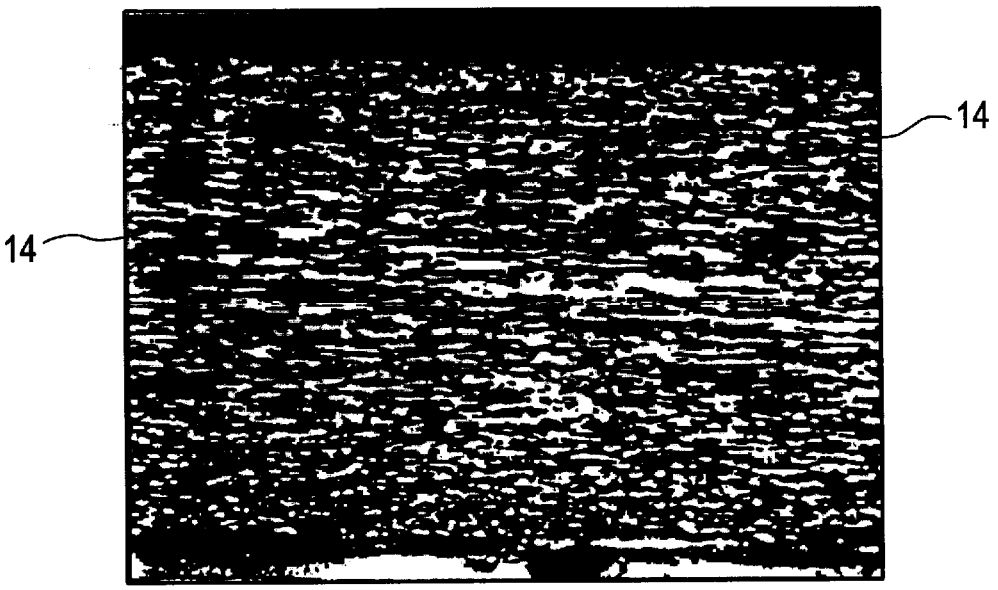
FIG. 1 is a diagram of the equiaxed grain structure of aluminum alloy stock produced according to the present invention.

The various continuous casting processes of the present invention have a number of novel process steps for producing aluminum alloy sheet having high strength, low earing, highly desirable forming properties, and/or an equiaxed/finer grain structure. As used herein, "continuous casting" refers to a casting process that produces a continuous strip as opposed to a process producing a rod or ingot. By way of example, the continuous casting processes can include heating the cast strip in front of the last hot mill stand (i.e., between the caster and first hot mill stand or between hot mill stands). The heater can reduce the load on the hot mill stands, thereby permitting greater reductions of the cast strip in the hot mill, provide a hot milled strip having an equiaxed grain structure, and/or facilitate self-annealing (i.e., recrystallization) of the unheated strip when the unheated strip is cooled, thereby obviating, in many cases, the need for a hot mill anneal. The increased hot mill reductions can eliminate one or more cold mill passes. The processes can further include continuous intermediate annealing of the cold rolled strip in an induction heater. The continuous anneal can provide more uniform mechanical properties for the aluminum alloy sheet, a finer grain size, controllable mechanical properties using a stabilizing anneal, and significant savings in operating and alloy costs and improvements in production capacity. It is a surprising and unexpected discovery that an induction heater in the continuous intermediate anneal can produce aluminum alloy sheet, that is useful for body stock, having yield and ultimate tensile strengths and percent elongation at break that are closely related to the temperature and duration of the stabilizing anneal. Commonly, the yield and ultimate tensile strengths of body stock decrease with increasing anneal time and temperature. These superior properties of the aluminum sheet of the present invention result from the relatively fine grain size and alloying of the sheet. The intermediate anneal is particularly useful for body stock. Finally, the continuous casting processes can include stabilization or back annealing of the cold rolled strip in an induction heater. The induction heater can provide aluminum alloy sheet having highly desirable properties, particularly useful for the production of body stock used for containers.

An important aspect of the present invention is that the aluminum alloy sheet that is produced in accordance with the various embodiments of the present invention can maintain sufficient strength and formability properties while having a relatively thin gauge. This is especially important when the aluminum alloy sheet is utilized in tab, end, and body stock for making drawn and ironed containers. The trend in the can making industry is to use thinner aluminum alloy sheet for the production of drawn and ironed containers, thereby producing a container containing less aluminum and having a reduced cost. However, to use thinner gauge aluminum sheet, the aluminum alloy sheet must still have the required physical characteristics. Surprisingly, continuous casting processes have been discovered which produce an aluminum alloy sheet that meets the industry's standards for tab, end, and/or body stock, particularly when utilized with the alloys of the present invention.

Heating the Cast Strip Between the Caster and First Hot Mill or Between Hot Mill Stands In the first novel process step discussed above, the cast and/or partially hot rolled strip (hereinafter collectively referred to as "unheated strip") is heated to an elevated temperature to provide an aluminum alloy sheet having a more equiaxed grain structure relative to other aluminum alloy sheet and to permit greater thickness reductions in hot milling. While not wishing to be bound by any theory, it is believed that the heater causes the strip to self-anneal, or recrystallize, after hot milling is completed, to form the equiaxed grain structure.

Figure 2:
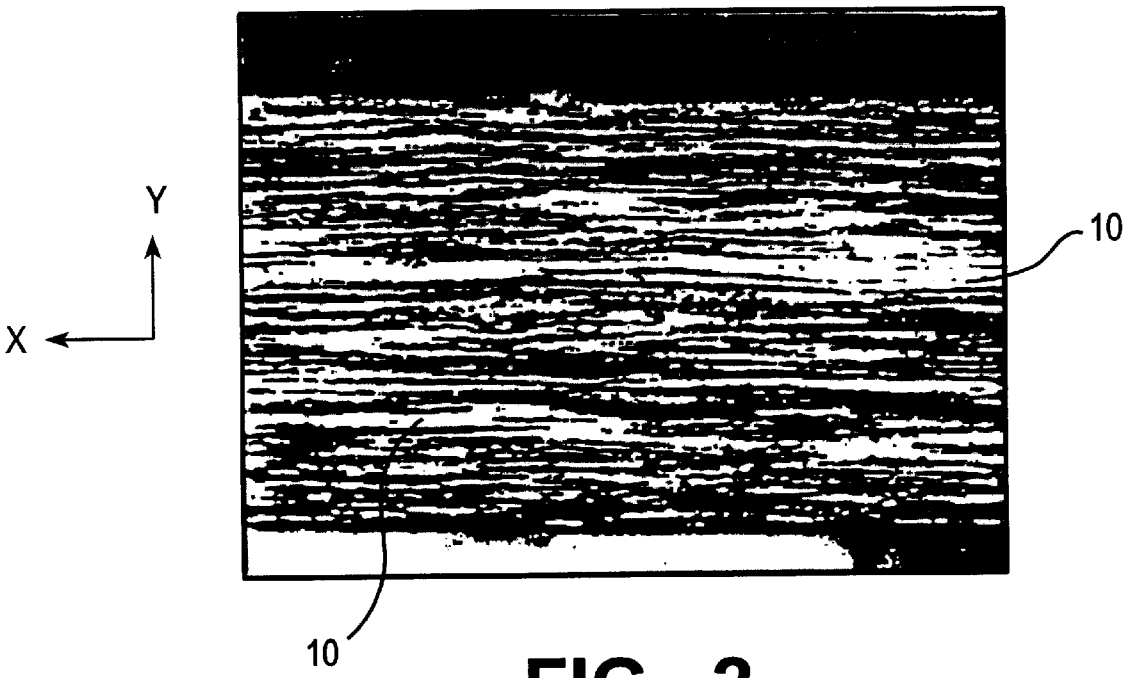
FIG. 2 is a diagram of the striated grain structure of aluminum alloy stock produced according to a conventional process.

Referring to FIGS. 1 and 2, the substantial differences in grain structure between the aluminum alloy sheet of the present invention and a comparative aluminum alloy sheet are illustrated. As shown in FIG. 2, the grains 10 of continuously cast comparative aluminum alloy sheet are shaped as a series of striations (i.e., long lenticular grains) oriented longitudinally throughout the aluminum alloy sheet. As will be appreciated, the striations cause the aluminum alloy sheet to have a high strength in the direction "X" parallel to the orientation of the striation and low strength in the direction "Y" that is normal to the direction of the striation (i.e., low shear strength). As a result, during fabrication, the comparative aluminum alloy sheet experiences edge cracking and excessive fines generation. Referring to FIG. 1, the aluminum alloy sheet of the present invention has a substantially equiaxed grain structure providing a relatively high strength substantially uniformly in all directions. An equiaxed grain structure provides a high degree of formability of the sheet, with a low degree of edge cracking, fines generation and earing.

The heating step is preferably conducted on a continuous as opposed to a batch basis and can be conducted in any suitable heating device. Preferred furnaces are solenoidal heaters, induction heaters, such as transflux induction furnaces, infrared heaters, and gas-fired heaters with solenoidal heaters being most preferred. Gas-fired heaters are less preferred for elevating the temperature of the unheated strip to the desired levels due to the limited ability of gas-fired heaters to reach the desired annealing temperatures at a reasonable cost and time allotted.

Preferably, the unheated strip is heated to a temperature (i.e., the output temperature of the heated strip as it exits the heater) that is in excess of the temperature of the unheated strip (i.e., the input temperature of the unheated strip as it enters the heater) and the recrystallization temperature of the strip but less than the melting point of the cast strip. Preferably, the heated temperature exceeds the heater input temperature of the unheated strip by at least about 20° F. (i.e., about 6° C.) and most preferably by at least about 50° F. (i.e., about 10° C.) but by no more than about 125° F. (i.e., about 52° C.) and most preferably by no more than about 80° F. (i.e., about 27° C.).

The temperature in the heating step depends upon whether the cast strip or partially hot rolled strip is heated. For heating of the cast strip, the minimum heated temperature preferably is about 820° F. (i.e., about 432° C.) and most preferably about 850° F. (i.e., about 454° C.) and the maximum heated temperature is about 1,080° F. (i.e., about 565° C.) and most preferably about 1,000° F. (i.e., about 538° C.). For heating of the partially hot rolled strip, the heated temperature preferably ranges from about 750° F. (i.e., about 399° C.) to about 850° F. (i.e., about 454° C.) . If the heated temperature is too great, the aluminum alloy sheet produced from the cast strip can experience edge cracking during hot rolling. The residence time of any portion of the unheated strip in the continuous heater is preferably at least about 8 seconds and no more than about 3 minutes, more preferably no more than about 2 minutes and most preferably no more than about 30 seconds. Other than cooling experienced in hot rolling, the heated strip is preferably not subjected to rapid cooling, such as by quenching, before hot milling.

It has been discovered that the thickness of the unheated strip is important to the degree of post hot mill self-annealing (i.e., recrystallization) realized due to the heating of the strip before hot milling. If the strip is too thick, portions of the strip can fail to be completely heated. Preferably, the gauge of the unheated strip is no more than about 24 mm, more preferably ranges from about 12 to about 24 mm, and most preferably ranges from about 16 to about 19 mm.

Continuous Intermediate Annealing of the Cold Rolled Strip in an Induction Heater In the second novel process step, a partially cold rolled strip is subjected to a continuous high temperature anneal to yield an aluminum sheet having a high degree of formability, substantially uniform physical properties, and strength properties that are controllable (i.e., the strength properties can increase with increasing temperature and time of stabilization or back annealing). The continuous anneal is preferably performed in an induction heater, such as a transflux induction furnace.

While not wishing to be bound by any theory, it is believed that these properties result from the ability of the induction heater to uniformly heat the partially cold rolled strip throughout its volume to produce a substantially uniform, fine-grain size throughout the length and width of the intermediate annealed strip. This is so because the induction heater magnetically induces magnetic fluxes substantially uniformly throughout the thickness of the strip. In contrast, conventional radiant heaters, particularly batch heaters, non-uniformly heat the partially cold rolled strip, whether in coiled or uncoiled form, throughout its volume. In such heaters, heat is conducted from the outer surfaces of the strip/coil towards the middle of the strip/coil with the outer surfaces experiencing greater exposure to thermal energy than the middle of the strip/coil. The nonuniform exposure to heat can cause a variation in grain size, especially in annealed coils, along the length of the strip. The middle of the strip/coil commonly has a smaller grain size and the exterior of the strip/coil a larger grain size.

The minimum annealing temperature is preferably about 700°F. (i.e., about 371° C.), more preferably about 800° F. (i.e., about 426° C.), and most preferably about 850° F. (i.e., about 454° C.), and the maximum annealing temperature is preferably about 1050° F. (i.e., about 565° C.), more preferably about 1025° F. (i.e., about 547° C.), and most preferably about 1000° F. (i.e., about 537° C.). The minimum residence time of any portion of the annealed strip in the heater preferably is about 2 seconds, and the maximum residence time is preferably about 2.5 minutes, more preferably about 30 seconds, and most preferably about 20 seconds, depending on the line speed of the strip through the heater.

Stabilization or Back Annealing of the Cold Rolled Strip in an Induction Heater In yet another novel process step, a cold rolled strip is subjected to a stabilization or back anneal (hereinafter collectively referred to as "stabilizing anneal") in a continuous heater to form aluminum alloy sheet having highly desirable properties. As in the continuous intermediate anneal above, the stabilization or back anneal can produce aluminum sheet having predetermined physical properties and provide increased capacity. The physical properties are highly controllable by varying the temperature and duration of the anneal (i.e., the line speed of the strip through the heater).

The continuous heater is preferably an induction heater, with a transflux induction furnace being most preferred.

The annealing temperature preferably ranges from about 300 to about 550° F. (i.e., about 148 to about 287° C.). The minimum residence time of any portion of the cold rolled strip in the induction heater is preferably about 2 seconds and the maximum residence time of any portion of the cold rolled strip is preferably about 2.5 minutes, more preferably about 30 seconds, and most preferably about 20 seconds, depending upon the line speed of the strip through the heater.

Processes Incorporating the Novel Process Steps

Figure 3:
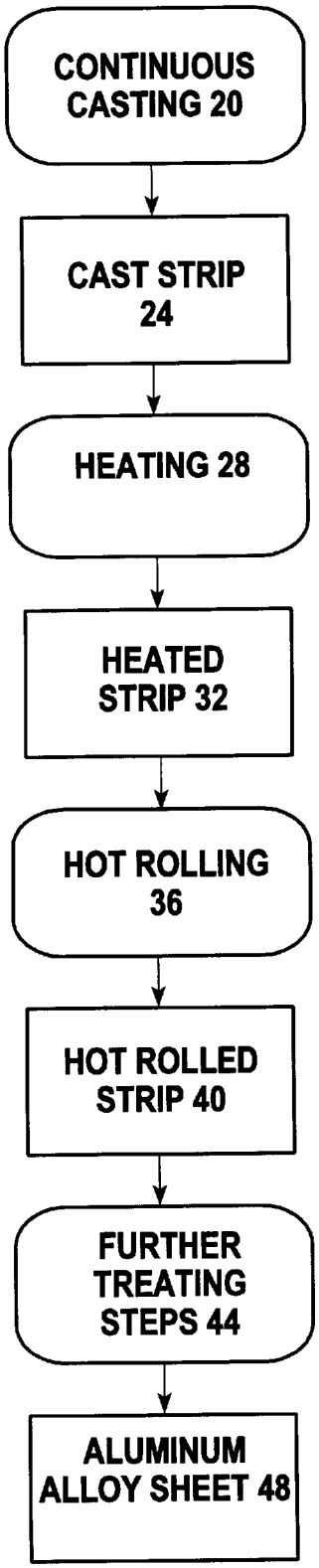
FIGS. 3,4,5 and 6 are block diagrams illustrating various embodiments of processes according to the present invention.

A first embodiment of a continuous casting process incorporating the step of heating the unheated strip is depicted in FIG. 3. This process is particularly useful for forming tab, body, and end stock for container manufacture.

Referring to FIG. 3, a melt of the aluminum alloy composition is formed and continuously cast 20 to form a cast strip 24. The continuous casting process can employ a variety of continuous casters, such as a belt caster or a roll caster. Preferably, the continuous casting process includes the use of a block caster for casting the aluminum alloy melt into a sheet. The block caster is preferably of the type disclosed in U.S. Pat. Nos. 3,709,281; 3,744,545; 3,747,666; 3,759,313 and 3,774,670, all of which are incorporated herein by reference in their entireties. Continuous casting is generally described in copending U.S. patent application Ser. Nos. 08/713,080 and 08/401,418, which are also incorporated herein by reference in their entireties.

The alloy composition according to the present invention can be formed in part from scrap metal material, such as plant scrap, container scrap and consumer scrap. Preferably, the alloy composition is formed with at least about 75% and more preferably at least about 95% total scrap for body stock and from about 5 to about 50% total scrap for tab and end stock.

To form the melt, the metal is charged into a furnace and heated to a temperature of about 1385° F. (i.e., 752° C.) (i.e., above the melting point of the feed material) until the metal is thoroughly melted. The alloy is treated to remove materials such as dissolved hydrogen and non-metallic inclusions which would impair casting of the alloy and the quality of the finished sheet. The alloy can also be filtered to further remove non-metallic inclusions from the melt. The melt is then cast through a nozzle and discharged into the casting cavity. The nozzle can include a long, narrow tip to constrain the molten metal as it exits the nozzle. The nozzle tip has a preferred thickness ranging from about 10 to about 25 millimeters, more preferably from about 14 to about 24 millimeters, and most preferably from about 14 to about 19 millimeters and a width ranging from about 254 millimeters to about 2160 millimeters.

The melt exits the tip and is received in the casting cavity which is formed by opposing pairs of rotating chill blocks. The metal cools and solidifies as it travels through the casting cavity due to heat transfer to the chill blocks. At the end of the casting cavity, the chill blocks, which are on a continuous web, separate from the cast strip 24. The blocks travel to a cooler where the treated chill blocks are cooled before being reused.

The cast temperature of the cast strip 24 exiting the block caster preferably exceeds the recrystallization temperature of the cast strip. The cast output temperature (i.e., the output temperature as the cast strip exits the caster) preferably ranges from about 800 to about 1050° F. (i.e., about 426 to about 565° C.) and more preferably from about 900 to about 1050° F. (i.e., about 482 to about 565° C.).

Upon exiting the caster, the cast strip is subjected to a heating (or annealing) step 28 as noted above to form a heated strip 32 having an equiaxed grain structure.

Upon exiting the heating step 28, the heated strip 32 is then subjected to hot rolling 36 in a hot mill to form a hot rolled strip 40. A hot mill includes one or more pairs of oppositely rotating rollers (i.e., one or more hot mill stands) having a gap separating the rollers that reduces the thickness of the strip as it passes through the gap between the rollers. The heated strip 32 preferably enters the hot mill with a minimum input temperature of about 800° F. (i.e., about 426° C.) and more preferably about 900° F. (i.e., about 482° C.) and a maximum input temperature of about 1000° F. (i.e., about 538° C.) and more preferably about 1000° F. (i.e., about 538° C.). The hot mill preferably reduces the thickness of the strip by at least about 80%, more preferably by at least about 84%, and most preferably by at least about 88% but by no more than about 94%. The gauge of the hot mill strip preferably ranges from about 0.065 to about 0.105 inches. The hot rolled strip preferably exits the hot mill with a minimum output temperature of about 550° F. (i.e., about 260° C.) and more preferably about 600° F. (i.e., about 315° C.) and a maximum output temperature of about 800° F. (i.e., about 426° C.) and more preferably about 800° F. (i.e., about 426° C.). In accordance with the present invention, it has been found that a relatively high reduction in gauge can take place with each pass of the hot rollers which can later eliminate one or more cold rolling passes.

For some alloys, the hot rolled strip 40 is commonly not annealed or solution heat treated directly after exiting the hot mill. The elimination of the additional annealing step and/or solution heat treating step (i.e., self-annealing) can lead to significant increases in capacity relative to processes using a batch anneal hot milling.

The hot rolled strip 40 is allowed to cool in a convenient manner to a temperature ranging from ambient temperature to about 120° F. (i.e., about 49° C.). Typically, the cooling time ranges from about 48 to about 72 hours. Depending upon the alloy, the strip 40 can be subjected to rapid cooling, such as by quenching, to cool the strip 40 for cold milling.

After the hot rolled sheet has cooled, it is subjected to further treating steps 44 to form the aluminum alloy sheet 48. The further treating steps 44 depend, of course, upon the alloy and intended use for the aluminum sheet 48.

Figure 4:
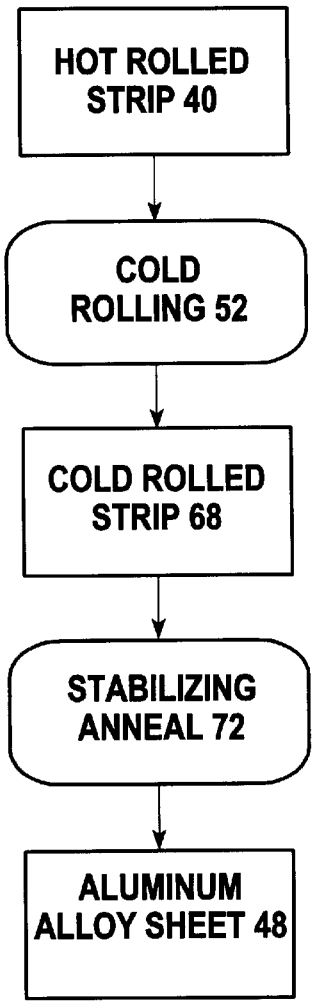

In one embodiment, FIG. 4 depicts the further treating steps 44 for tab stock useful in container fabrication. Referring to FIG. 4, the cooled hot rolled strip 40 is subjected to cold rolling 52 to form a cold rolled strip 68 having the final gauge. The cold rolling can be performed in a number of cold mill passes through one or more pairs of rotating cold rollers. During cold rolling 52, the thickness of the strip is preferably reduced by at least about 35% /stand and more preferably from about 35 to about 60%/stand and, more preferably, by from about 45 to about 55%/stand for a total reduction in the cold rolling step 52 preferably of at least about 70% and more preferably ranging from about 85 to about 95%. Preferably, the reduction to final gauge is performed in 2 to 3 passes through rotating cold rollers.

The final gauge is selected based on the final desired properties of the aluminum alloy sheet 48. Preferably, the minimum final gauge of the aluminum alloy sheet is about 0.20 mm, more preferably about 0.22 mm, and most preferably, about 0.24 mm while the maximum final gauge is about 0.61 mm, more preferably about 0.56 mm, and most preferably about 0.46 mm.

The cold rolled strip 68 is subjected to a stabilizing anneal 72 to form the aluminum alloy sheet 48. Although any heater can be employed in the stabilizing anneal, it is most preferred that a continuous heater, such as an induction heater, be used. The temperature and duration of a stabilizing anneal 72 utilizing an induction heater are discussed above. The temperature of a batch stabilizing 72 anneal preferably ranges from about 300 to about 500° F. (i.e., about 149 to about 260° C.). The duration of a batch stabilizing anneal 72 preferably ranges from about 10 to about 20 hours.

In one process configuration, the stabilizing anneal can be located in the tab cleaning line. As will be appreciated, the tab cleaning line includes the steps of (i) contacting the aluminum alloy sheet with a caustic cleaning solution, such as a caustic cleaning solution, to remove oil and other residue from the sheet; (ii) contacting the sheet with a rinsing solution, such as water, to remove the caustic cleaner from the sheet; and (iii) applying a lubricant, such as oil, to the rinsed sheet. The lubed sheet is later passed through a leveler and splitter to form tab stock. The stabilizing anneal 72 can be located directly before step (i) provided that the caustic cleaning solution has a lower concentration of caustic cleaner than conventional processes to avoid overetching of the sheet. Overetching can result from the increased temperature of the sheet due to the stabilizing anneal. Alternatively, the stabilizing anneal 72 can be located after step (i), such as between steps (i) and (ii) or steps (ii) and (iii), or after step (iii). This process configuration is highly beneficial because the ability to use more dilute caustic cleaning solutions due to more efficient cleaning caused by the higher sheet temperature from the stabilization annealing can result in significant cost savings.

Aluminum alloy sheet produced by this process is particularly useful as tab stock. An aluminum alloy composition that is particularly useful for tab stock includes:

(i) Manganese, preferably in an amount of at least about 0.05 wt % and more preferably at least about 0.10 0.20 wt % and no more than about 0.5 wt % and more preferably no more than about 0.20 wt %.

(ii) Magnesium, preferably in an amount ranging from about 3.5 to about 4.9 wt %.

(iii) Copper, preferably in an amount of at least about 0.05 wt % and no more than about 0.15 wt % and most preferably no more than about 0.10 wt %.

(iv) Iron, preferably in an amount of at least about 0.05 wt %. and more preferably at least about 0.10 wt % and no more than about 0.35 wt% and more preferably no more than about 0.20 wt %.

(v) Silicon, preferably in an amount of at least about 0.05 wt % and no more than about 0.20 wt % and more preferably no more than about 0.10 wt %.

The aluminum alloy sheet 48 has properties that are particularly useful for tab stock. Preferably, the as-rolled yield strength is at least about 41 ksi and more preferably at least about 46 ksi and no more than about 49 ksi and more preferably no more than about 51 ksi. Preferably, the aluminum alloy sheet 48 has an elongation of at least about 3%. and more preferably at least about 6% and no more than about 8% . The as-rolled tensile strength of the aluminum alloy sheet 48 preferably is at least about 49 ksi, more preferably at least about 55 ksi and most preferably at least about 57 ksi and no more than about 61 ksi, and most preferably no more than about 59 ksi. The sheet 48 preferably has a tab strength of at least about 2 kg, more preferably at least about 5 pounds, (i.e., about 2.3 kg), and most preferably at least about 6 pounds (i.e., about 2.7 kg), and preferably no more than about 3.6 kg and most preferably no more than about 8 pounds (i.e., about 3.6 kg).

In another embodiment shown in FIG. 5, the further treating steps 44 exclude a stabilizing anneal to produce end stock and/or tab stock (that is later coated). As will be appreciated, heating of the end or tab stock in the coating line performs the same function as the stabilizing or back anneal.

Figure 5:
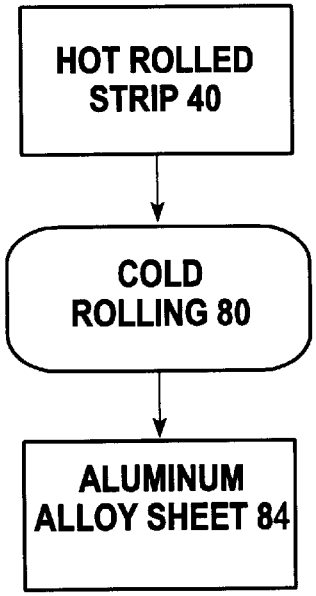

Referring to FIG. 5, the cooled hot rolled strip 40 is subjected to cold rolling 80 to yield aluminum alloy sheet 84. During cold rolling 80, the thickness of the strip is preferably reduced by at least about 70% and more preferably by from about 80 to about 95%. The minimum final gauge of the aluminum alloy sheet 84 is preferably about 0.007 inches, more preferably about 0.095 inches, and most preferably about 0.085 inches, and the maximum final gauge is preferably about 0.012 inches, more preferably about 0.0115 inches, and most preferably about 0.0110 inches.

An aluminum alloy composition that is particularly useful in this process for tab stock includes:

(i) Manganese, preferably in an amount of at least about 0.05 wt % and no more than about 0.23 wt % and more preferably no more than about 0.15 wt %.

(ii) Magnesium, preferably in an amount of at least about 3.8 wt % and no more than about 4.9 wt %, and most preferably no more than about 4.7 wt %.

(iii) Copper, preferably in amount of at least about 0.05 wt % and no more than about 0.15 wt % and more preferably no more than about 0.10 wt %.

(iv) Iron, preferably in an amount of at least about 0.20 wt % and no more than about 0.35 wt % and more preferably no more than about 0.30 wt %.

(v) Silicon, preferably in an amount of at least about 0.05 wt % and no more than about 0.20 wt % and more preferably no more than about 0.10 wt %.

A most preferred aluminum alloy composition for tab stock includes the following constituents:

(i) Manganese in an amount of at least about 0.05 wt % and no more than about 0.15 wt %.

(ii) Magnesium in an amount of at least about 4.0 wt % and no more than about 4.7 wt %.

(iii) Copper in an amount of at least about 0.05 wt % and no more than about 0.10 wt %.

(iv) Iron in an amount of at least about 0.20 wt % and no more than about 0.30 wt %.

(v) Silicon in an amount of at least about 0.05 wt % and no more than about 0.10 wt %.

An aluminum alloy composition that is particularly useful in this process for the production of end stock includes:

(i) Manganese, preferably in an amount of at least about 0.05 wt % and no more than about 0.20 wt % and more preferably no more than about 0.15 wt %.

(ii) Magnesium, preferably in an amount of at least about 3.8 wt % and more preferably at least about 4.0 wt %, and no more than about 5.2 wt %, and more preferably no more than about 4.7 wt %.

(iii) Copper, preferably in amount of at least about 0.05 wt % and no more than about 0.15 wt % and more preferably no more than about 0.10 wt %.

(iv) Iron, preferably in an amount of at least about 0.20 wt % and no more than about 0.35 wt % and more preferably no more than about 0.30 wt %.

(v) Silicon, preferably in an amount of at least about 0.05 wt % and no more than about 0.20 wt % and more preferably no more than about 0.15 wt %.

A most preferred aluminum alloy composition for end stock includes the following constituents:

(i) Manganese in an amount of at least about 0.05 wt % and no more than about 0.15 wt %.

(ii) Magnesium in an amount of at least 3.8 wt % and no more than about 4.7 wt %.

(iii) Copper in an amount of at least about 0.05 wt % and no more than about 0.10 wt %.

(iv) Iron in an amount of at least about 0.20 wt % and no more than about 0.30 wt %.

(v) Silicon in an amount of at least about 0.05 wt % and no more than about 0.15 wt %.

The aluminum alloy sheet 84 has properties that are particularly useful for end stock. The aluminum alloy sheet 84 preferably has an after-coated yield strength of at least about 41 ksi, more preferably at least about 47 ksi, and most preferably at least about 47.5 ksi. The aluminum alloy sheet 84 preferably has an after-coated ultimate tensile strength of at least about 49 ksi and more preferably at least about 51 ksi and most preferably at least about 53 ksi and of no more than about 55 ksi and most preferably no more than about 60 ksi. The aluminum alloy sheet 84 preferably has an elongation of at least about 3% and most preferably at least about 6% and of no more than about 8%.

Figure 6:
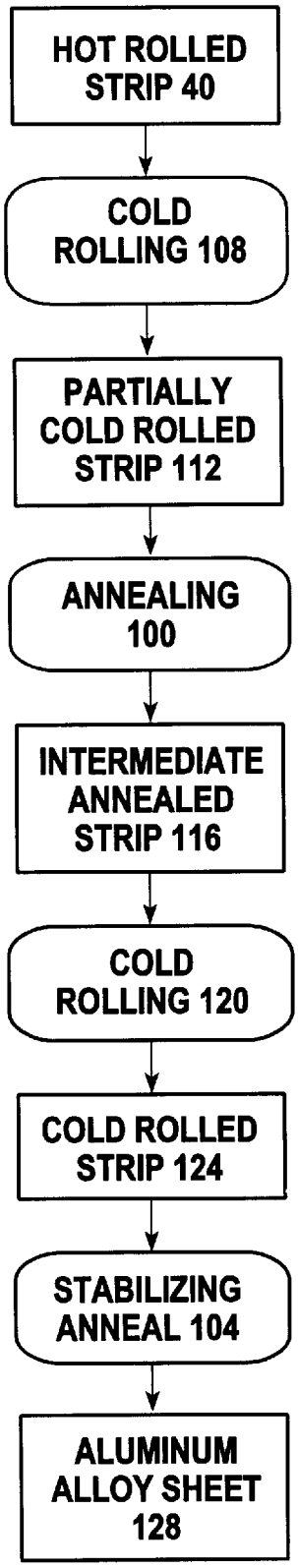

In yet another embodiment shown in FIG. 6, the further treating steps 44 include both an intermediate anneal 100 and a stabilizing anneal 104 to produce body stock. The time and temperature of the stabilizing or back anneal determine the properties of the body stock.

Referring again to FIG. 6, the cooled hot rolled strip 40 is subjected to cold rolling 108 to form a partially cold rolled strip 112. During cold rolling 108, the thickness of the strip is preferably reduced by at least about 40% and more preferably by at least about 45% and most preferably by at least about 50% and no more than about 70% and most preferably no more than about 65%. The minimum gauge of the partially cold rolled strip 112 is preferably at least about 0.012 inches and more preferably at least about 0.015 inches, and the maximum gauge is preferably no more than about 0.035 and more preferably no more than about 0.030 inches. The reductions are performed in 1 pass through rotating cold rollers.

The partially cold rolled strip 112 is subjected to an intermediate annealing step 100 to form an intermediate annealed strip 116 having reduced residual cold work and less earing. In the intermediate annealing step 100, a continuous or batch heater can be employed, with a continuous heater such as an induction heater being most preferred.

The temperature of the intermediate anneal depends upon the type of furnace employed. The temperature and duration of the anneal using a continuous heater are discussed above. For a batch heater, the strip 112 is preferably intermediate annealed at a minimum temperature of at least about 650° F. (i.e., about 343° C.), and preferably at a maximum temperature of no more than about 900° F. (i.e., about 482° C.) for a soak time ranging from about 2 to about 3 hrs.

The intermediate annealed strip 116 is subjected to further cold rolling 120 to form the cold rolled strip 124. The amount of reduction in the cold rolling step 120 depends on the final gauge of the cold rolled strip 124 and the gauge of the partially cold rolled strip 112. Preferably, the final gauge of the aluminum alloy sheet 128 is at least about 0.009 inches, more preferably at least about 0.010 inches and no more than about 0.013 inches and more preferably no more than about 0.125 inches. In a preferred embodiment, the cold mill reduction in the cold rolling step 120 is from about 40 to about 65%. The cold rolling step is preferably performed in 1 pass.

The cold rolled strip 124 is subjected to a stabilizing anneal 104 to form the aluminum alloy sheet 128. Although any heater can be employed in the stabilizing anneal, it is most preferred that a continuous (e.g., induction) heater be used if a continuous (e.g., induction) heater were employed in the intermediate annealing step 100. The temperature and duration of a stabilizing anneal 104 utilizing an induction heater is discussed in detail above. For a batch heater, the annealing temperature ranges from about 300 to about 450° F. for a soak time ranging from about 2 to about 3 hrs.

Aluminum alloy sheet 128 is particularly useful as body stock. An aluminum alloy composition that is particularly useful in this process for body stock includes:

(i) Manganese, preferably in an amount of at least about 0.85 wt % and more preferably at least about 0.9 wt % and of no more than about 1.2 wt % and more preferably no more than about 1.1 wt %.

(ii) Magnesium, preferably in an amount of at least about 0.9 wt % and more preferably at least about 1.0 wt % and of no more than about 1.5 wt %.

(iii) Copper, preferably in amount of at least about 0.05 wt % and more preferably at least about 0.20 wt % and no more than about 0.50 wt %.

(iv) Iron, preferably in an amount of at least about 0.05 wt % and more preferably of at least about 0.35 wt % and of no more than about 0.60 wt %.

(v) Silicon, preferably in an amount of at least about 0.05 wt % and more preferably of at least about 0.3 wt % and of no more than about 0.5 wt % and more preferably no more than about 0.4 wt %.

A most preferred aluminum alloy composition for body stock includes the following constituents:

(i) Manganese in an amount of at least about 0.85 wt % and no more than about 1.1 wt %.

(ii) Magnesium in an amount of at least about 0.10 wt % and no more than about 1.5 wt %.

(iii) Copper in an amount of at least about 0.35 wt % and no more than about 0.50 wt %.

(iv) Iron in an amount of at least about 0.35 wt % and no more than about 0.60 wt %.

(v) Silicon in an amount of at least about 0.2 wt % and no more than about 0.4 wt %.

The various alloying elements are believed to account partly for the superior properties of the aluminum alloy sheet of the present invention. Without wishing to be bound by any theory, magnesium and manganese are believed to increase the ultimate and yield tensile strengths; copper is believed to retard after-bake drops in mechanical properties for body stock; iron is believed not only to provide increased ultimate and yield tensile strengths but also to provide a smaller grain size; and silicon is believed to provide a larger alpha phase transformation particle size which helps inhibit galling/scoring in the body maker operation.

The aluminum alloy sheet has properties that are particularly useful for body stock. When the aluminum alloy sheet is to be used as body stock, the alloy sheet preferably has an as rolled tensile strength of at least about 40 ksi, more preferably at least about 42 ksi, and most preferably at least about 42.5 ksi and of no more than about 47 ksi, more preferably no more than about 46 ksi, and most preferably no more than about 45 ksi. The as-rolled yield strength preferably is at least about 37 ksi, more preferably at least about 38 ksi, and most preferably at least about 39 ksi and no more than about 43 ksi, more preferably no more than about 42 ksi, and most preferably no more than about 41 ksi. The aluminum alloy sheet 128 preferably has an elongation of at least about 3% and most preferably at least about 4% and of no more than about 10% and most preferably no more than about 8%.

To produce acceptable drawn and ironed container bodies, aluminum alloy sheet 128 used as body stock should have a low earing percentage. The earing should be such that the bodies can be conveyed on the conveying equipment and the earing should not be so great as to prevent acceptable handling and trimming of the container bodies. Preferably, the aluminum alloy sheet 128, according to the present invention, has a tested earing of no more than about 2.0% and more preferably no more than about 1.9% and most preferably no more than about 1.8%.

Container bodies fabricated from the aluminum alloy sheet 128 of the embodiment of the present invention have relatively high strengths. The container bodies have a minimum dome reversal strength (or minimum buckle strength) of about 90 psi and more preferably at least about 93 psi and a maximum dome reversal strength (or maximum buckle strength) of no more than about 98 psi at current commercial thicknesses. The column strength of the container bodies is preferably at least about 180 psi and most preferably at least about 210 psi and no more than about 280 psi and most preferably no more than about 260 psi.

The relatively low earing and high strength properties are readily realized due to the ability of the properties of the cold rolled strip to be varied with anneal time and temperature. The direct relationship between the strip's strength properties on the one hand and the time and temperature of the stabilize anneal on the other permits the physical properties of the aluminum alloy sheet to be selectively controlled. Because earing is directly related to the amount of cold rolling reduction performed, the cold rolling step 120 can use a relatively low amount of cold rolling reduction to realize an acceptable earing. Preferably, at least about 30% of the total gauge reduction attributable to cold rolling is performed in the cold rolling step 108. Because the reduced amount of cold rolling means less work hardening and therefore lower strength properties, the stabilization anneal is used to improve the strength properties to the desired levels.

Figure 7:
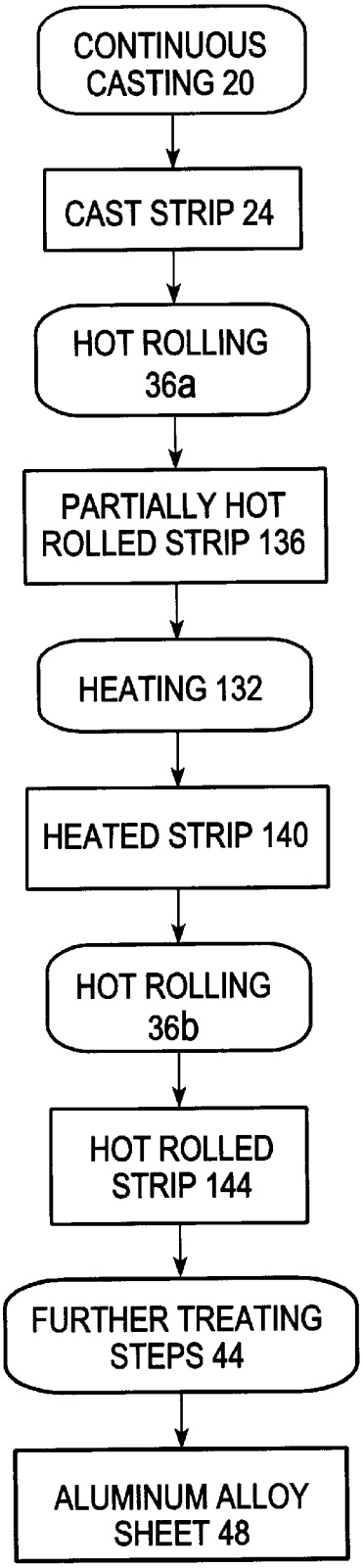
FIG. 7 is a block diagram illustrating yet another embodiment of a process according to the present invention.

FIG. 7 depicts an alternative configuration for body stock to that shown in FIGS. 3 and 6. As shown in FIG. 7, the heating step 132 is performed during (but not after) hot rolling. As will be appreciated, this configuration can be combined with any of the embodiments for the further treating steps 44 shown in FIGS. 4–6.

Referring to FIG. 7, the heating step 132 is performed between one or more pairs of hot rolling stands. This will typically be between the first and second hot rolling stands to elevate the temperature of the strip, during hot milling, to a level above the heater input temperature of the strip. Thus, the cast strip 24 is hot rolled 36*a* to form a partially hot rolled strip 136, heated 132 to form a heated strip 140, and hot rolled 36*b* to form a hot rolled strip 144. The preferred temperature in the heating step ranges from about 750 to about 850° F. (i.e., about 399 to about 454° C.). In this configuration, the cast strip 24 is preferably not annealed or otherwise heated prior to the first hot rolling stand.

The above-noted processes employed for end and body stock can be employed with some modification to produce sheet for other applications. By way of example, the sheet can be used to fabricate foil products such as cooler fins. The preferred alloy composition for such sheet is as follows:

(i) Manganese in an amount of no more than about 0.05 wt %.

(ii) Magnesium in an amount ranging from about 0.05 to about 0.10 wt %.

(iii) Copper in an amount ranging from about 0.05 to about 0.10 wt %.

(iv) Iron in an amount ranging from about 0.4 to about 1.0 wt %.

(v) Silicon in an amount ranging from about 0.3 to about 1.1 wt %.

Figure 8:
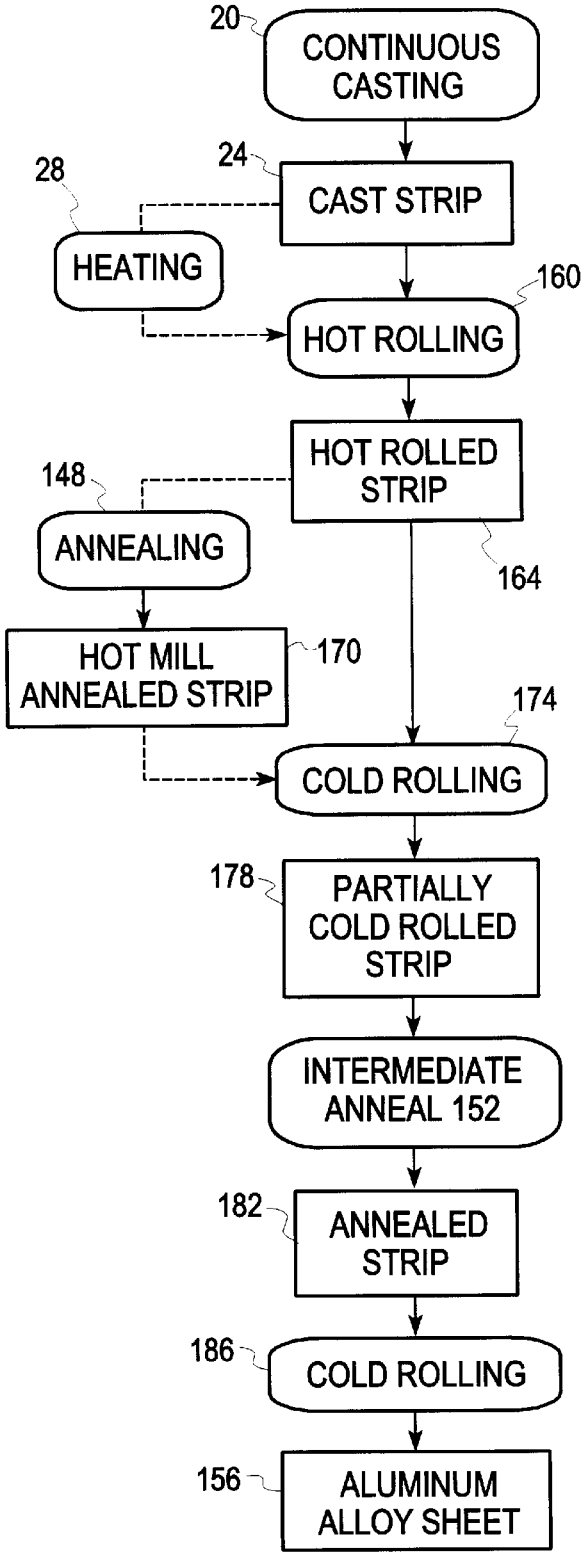
FIG. 8 is a block diagram depicting a further embodiment of a process according to the present invention.

FIG. 8 depicts yet another embodiment of a process according to the subject invention. In this embodiment, the process includes an optional heating step 28 before or during hot rolling, an optional hot mill annealing step 148, and an intermediate annealing step 152. Best results are realized for a batch intermediate anneal if both a batch hot mill anneal and continuous heating, before the last hot rolling stand, are employed, and for an intermediate anneal using an induction heater if no hot mill anneal and only continuous heating before the last hot rolling stand is employed. This process produces aluminum sheet 156 having superior physical properties that is particularly useful for body stock.

Referring to FIG. 8, a melt of the aluminum alloy composition is formed and continuously cast 20 to provide a cast strip 24. The nozzle tip size preferably ranges from about 10 to about 25mm and more preferably from about 10 to about 18.0 mm, with a maximum tip size of 17.5 mm being most preferred, and the cast strip 24 is hot rolled 160 to form a hot rolled strip 164. The cast strip 24 can optionally be subjected to a heating step 28 as noted above to provide a more equiaxed grain structure in the strip. In the hot rolling step 160, the cast strip 24 is preferably reduced in thickness by an amount of at least about 80%, more preferably at least about 84%, and most preferably at least about 88% but no more than about 94%, more preferably no more than about 94%, and most preferably no more than about 94% to a gauge preferably ranging from about 0.065 to about 0.105 inches.

The hot rolled strip 164 is hot mill annealed 148 in a batch or continuous heater. The continuous heater can be a gas-fired, infrared, or an induction heater.

The temperature and duration of the anneal depend upon the type of furnace employed. The strip is preferably intermediate annealed at a minimum temperature of at least about 650° F. (i.e., about 343° C.), and preferably at a maximum temperature of no more than about 900° F. (i.e., about 482° C.). For continuous heaters, the annealing time for any portion of the strip is preferably a maximum of about 2.5 minutes, more preferably about 30 seconds, and most preferably about 20 seconds and a minimum of about 2 seconds. For batch heaters, the annealing time is preferably a minimum of about 2 hours and is preferably a maximum of about 3 hours.

Referring again to FIG. 8, the hot mill anneal strip 170 is allowed to cool and then subjected to cold rolling 174 to form a partially cold rolled strip 178. During cold rolling 174, the thickness of the strip 170 is reduced by at least about 40% and more preferably at least about 50% but no more than about 70% and more preferably no more than about 65%. Preferably, the reduction to intermediate gauge is performed in 1 to 2 passes. The minimum gauge of the partially cold rolled strip 178 is preferably about 0.012 inches and more preferably about 0.0115 inches, and the maximum gauge is preferably about 0.035 inches and more preferably about 0.030 inches.

The partially cold rolled strip 178 is intermediate annealed 152 to form an annealed strip 182. The intermediate annealing step 152 can be performed in a continuous or batch heater. The preferred continuous heater is an induction heater, with a transflux induction heater being most preferred. The duration and temperature of the anneal 152 using an induction heater preferably are set forth above. For a batch heater, the strip 178 is preferably intermediate annealed 152 at a minimum temperature of at least about 650° F. (i.e., about 343° C.), and preferably at a maximum temperature of no more than about 900° F. (i.e., about 482° C.). The annealing time for a batch heater preferably ranges from about 2 to about 3 hours.

The annealed strip 182 is preferably not rapidly cooled, such as by quenching, after the annealing step or solution heat treated.

The annealed strip 182 is allowed to cool and subjected to cold rolling 186 to form aluminum alloy sheet 156. Preferably, the partially cold rolled strip 178 is reduced in thickness by an amount of at least about 40% and more preferably at least about 50% but no more than about 70% and more preferably no more than about 65% to a gauge ranging from about 0.009 to about 0.013 inches in one pass.

An aluminum alloy composition that is particularly useful for body stock in this embodiment includes:

(i) Manganese, preferably in an amount of at least about 0.85 wt % and more preferably at least about 0.9 wt % but no more than about 1.2 wt % and more preferably no more than about 1.1 wt %.

(ii) Magnesium, preferably in an amount of at least about 0.9 wt % and more preferably at least about 1.0 wt % but no more than about 1.5 wt %.

(iii) Copper, preferably in amount of at least about 0.20 wt % but no more than about 0.50 wt %.

(iv) Iron, preferably in an amount of at least about 0.35 wt % but no more than about 0.50 wt % and more preferably no more than about 0.60 wt %.

(v) Silicon, preferably in an amount of at least about 0.3 wt % but no more than about 0.5 wt % and more preferably no more than about 0.4 wt %.

A particularly useful aluminum alloy composition for body stock using this process includes the following constituents:

i) Manganese in an amount of at least about 0.85 but no more than about 1.1 wt %.

(ii) Magnesium in an amount of at least about 0.10 but no more than about 1.5 wt %.

(iii) Copper in an amount of at least about 0.35 but no more than about 0.50 wt %.

(iv) Iron in an amount of at least about 0.35 but no more than about 0.60 wt %.

(v) Silicon in an amount of at least about 0.2 but no more than about 0.4 wt %.

The aluminum alloy sheet has properties that are particularly useful for body stock. When the aluminum alloy sheet is to be used as body stock, the alloy sheet preferably has an as-rolled yield strength of at least about 37 ksi and more preferably at least about 38 ksi, and most preferably at least about 39 ksi but no more than about 43 ksi and more preferably no more than about 42 ksi, and most preferably no more than about 41 ksi. The as-rolled tensile strength preferably is at least about 40 ksi, more preferably at least about 42 ksi, and most preferably at least about 42.5 ksi but no more than about 47 ksi, more preferably no more than about 46 ksi, and most preferably no more than about 45 ksi. The aluminum alloy sheet 128 should have an elongation of at least about 3% and more preferably at least about 4% but no more than 10% and more preferably no more than about 8%.

To produce acceptable drawn and ironed container bodies, aluminum alloy sheet 128 used as body stock should have a low earing percentage. Preferably, the aluminum alloy sheet 128, according to the present invention, has a tested earing of no more than about 2.0% and more preferably no more than about 1.9% and most preferably no more than about 1.8%.

Container bodies fabricated from the aluminum alloy sheet 128 of the embodiment of the present invention have relatively high strengths. The container bodies have a minimum dome reversal strength of at least about 90 psi and more preferably at least about 93 psi but no more than about 98 psi at current commercial thicknesses. The column strength of the container bodies preferably is at least about 180 psi and more preferably at least about 210 psi but no more than about 280 psi and most preferably no more than about 260 psi.

EXAMPLE 1

Various aluminum alloy sheets useful for tab and end stock were fabricated by a process incorporating heating of the cast strip and various other comparative continuous casting processes to determine if the heating of the continuously cast strip actually impacted the properties of the sheet. Samples 1 and 2 were fabricated by the process of FIGS. 3 and 4 and samples 3 and 4 by the other processes. Samples 1 and 2 were continuously heated before hot milling at a temperature of about 800° F. (i.e., 426° C.) and for a time of at least about 0.5 minutes (at a gauge of 0.075 inches). The bare tab stock samples were subjected to two cold mill passes with a back anneal at a temperature of about 350° F. (i.e., 177° C.) for a soak time of about 3 hours. Samples 3 and 4 were hot milled to a gauge of 0.1 inches and then subjected to a batch anneal after hot milling at a temperature of about 725° F. (i.e., 385° C.) and for a soak time of about 3 hours. The hot mill anneal strip was then subjected to three cold mill passes. Samples 3 and 4 were not heated before hot milling.

The results are set forth in Table I below. As used herein, "UTS" refers to ultimate tensile strength and is measured in ksi unless stated otherwise, "YTS" refers to yield tensile strength and is measured in ksi unless stated otherwise, "El" and "Elong" refer to elongation and is measured in percent unless stated otherwise, and all alloying elements (i.e., Si, Fe, Cu, Mn, and Mg) are measured in weight percent unless stated otherwise.

TABLE I

| Sample # | Ann type | UTS | YTS | El | Si | Fe | Cu | Mn | Mg |
|---|---|---|---|---|---|---|---|---|---|
| 1 | Heater | 58.58 | 51.04 | 7.36 | 0.1 | 0.24 | 0.076 | 0.21 | 4.91 |
| 2 | Heater | 57.47 | 50.02 | 8.08 | 0.1 | 0.25 | 0.076 | 0.2 | 4.41 |
| 3 | Batch | 60.44 | 51.8 | 7.09 | 0.1 | 0.24 | 0.078 | 0.2 | 4.86 |
| 4 | Batch | 55.4 | 47.5 | 6.9 | 0.1 | 0.23 | 0.08 | 0.21 | 4.5 |

Samples 1 and 2 had superior properties as tab stock for canmaking applications. The ultimate and yield tensile strengths were at acceptable levels while the elongation was higher. The elongation was significantly higher than the elongation of sample 4. The fact that the thinner gauge strip produced aluminum alloy sheet having properties acceptable for canmaking demonstrates that the heating step can eliminate one cold mill pass. Accordingly, heating of the cast strip before hot rolling can have a significant impact on the physical properties of certain alloys and the heating of the cast strip can eliminate the need for a hot mill anneal.

EXAMPLE 2

Further tests were conducted to compare aluminum alloy sheet fabricated using either a batch or continuous intermediate anneal and aluminum alloy sheet fabricated using an induction heater in an intermediate anneal with and without a quench. The samples were useful as body stock in canmaking. The samples were useful as body stock in canmaking. The samples were taken from the same master coil and therefore had the same compositions. The composition is as follows: (i) Mg 1.35 to 1.45 wt. %; (ii) Mn 1.05 to 1.07 wt. %; (iii) Si 0.39 to 0.41 wt. %; (iv) Cu 0.48 to 0.50 wt. %; and (v) Fe 0.57 to 0.59 wt. %. The sample compositions are set forth in Table II. Also set forth in Table II are the processes used to fabricate each sample. All continuous anneals were performed using a transflux induction heater.

TABLE II

| Sample # | Hot Mill Gauge (Inches) | Intermediate Cold Mill Gauge (Inches) | Type of Anneal and Anneal Temp. (°F.) | Quench | Finish Cold Mill Gauge (Inches) | Type of Anneal and Anneal Temp. (°F.) | Quench |
|---|---|---|---|---|---|---|---|
| 5 | 0.1 | 0.026 | Batch at 705° F. | N | N/A | N/A | N/A |
| 6 | 0.1 | 0.026 | Continuous at 900° F. | N | N/A | N/A | N/A |
| 7 | 0.1 | 0.026 | Continuous at 900° F. | Y | N/A | N/A | N/A |
| 8 | 0.1 | 0.026 | | N | 0.0106 | Batch at 705° F. | N |
| 9 | 0.1 | 0.026 | | N | 0.0106 | Continuous at 900° F. | N |
| 10 | 0.1 | 0.026 | | N | 0.0106 | Continuous at 900° F. | Y |

Table III below presents the test results. During fabrication, samples of the sheet were taken at a number of locations along the width and length of the strip. The locations along the width were (i) at the edge nearest the position of the operator, (ii) at the center of the strip, and (iii) at the far edge of the strip. The positions are respectfully referred to as "Operator", "Center", and "Drive". Additionally, the strip was longitudinally divided into three 100-ft. sections, sections 1, 2 and 3, with a sample being taken in each section. All strength properties (i.e., YTS and UTS) are in ksi and both earing and elongation are in percent.

TABLE III

| Operator UTS | YTS | Elong. | Center UTS | YTS | Elong. | Drive UTS | YTS | Elong | Section | Earing |
|---|---|---|---|---|---|---|---|---|---|---|
| Sample 5 | 0.026" Gauge Batch Anneal | | | | | | | | | |
| 28.4 | 13.9 | 17.47 | 28.1 | 12.98 | 15.94 | 28.2 | 13.16 | 16.64 | 1 | 0.89 |
| 28.5 | 13.61 | 17.16 | 28.3 | 13.35 | 17.68 | 28.2 | 13.31 | 17.2 | 2 | |
| 28.4 | 13.09 | 20 | 28.3 | 13.18 | 18.92 | 28.3 | 13.19 | 17.04 | 3 | |
| 28.4 | 13.5 | 18.2 | 28.2 | 13.2 | 17.5 | 28.2 | 13.2 | 17.0 | Avg | |
| Sample 6 | 0.026" Continuous Anneal No Quench | | | | | | | | | |
| 29.9 | 13.27 | 19.64 | 29.9 | 12.92 | 20.2 | 29.9 | 12.72 | 20.6 | 1 | 1.45 |
| 29.9 | 12.66 | 19.75 | 30.2 | 12.76 | 22.4 | 30.1 | 12.97 | 23 | 2 | |
| 29.97 | 13.15 | 16.16 | 30 | 13.16 | 20.7 | 30.1 | 13.13 | 19.03 | 3 | |
| 29.9 | 13.0 | 19.2 | 30.0 | 12.9 | 21.1 | 30.0 | 12.9 | 20.8 | Avg | |
| Sample 7 | 0.026" Continuous Anneal Quenched | | | | | | | | | |
| 30.2 | 13.07 | 20.2 | 30.2 | 13.05 | 18.71 | 30.1 | 12.62 | 19.18 | 1 | 1.32 |
| 29.8 | 13.27 | 20.1 | 30.1 | 13.27 | 20 | 29.9 | 13.16 | 21.2 | 2 | |
| 30 | 13.45 | 21.3 | 30 | 13.39 | 19.73 | 30.1 | 13.4 | 20.5 | 3 | |
| 30.0 | 13.3 | 20.5 | 30.1 | 13.2 | 19.5 | 30.0 | 13.1 | 20.3 | Avg | |
| Sample 8 | 0.0106" Finish Gauge Batch Anneal | | | | | | | | | |
| 41.9 | 41.3 | 0.55 | 41.8 | 41.5 | 0.61 | 41.7 | 40.8 | 0.62 | 1 | 1.56 |
| 41.5 | 40.8 | 0.62 | 42 | 41.7 | 0.56 | 42.1 | 42 | 0.57 | 2 | |
| 42.2 | 41.8 | 0.56 | 41.9 | 41.2 | 0.55 | 41.9 | 41.5 | 0.56 | 3 | |
| 41.9 | 41.3 | 0.6 | 41.9 | 41.5 | 0.6 | 41.9 | 41.4 | 0.8 | Avg | |
| Sample 9 | 0.0106" Finish Gauge Continuous Anneal No Quench | | | | | | | | | |
| 44.6 | 44.2 | 0.68 | 44.4 | 43.7 | 0.5 | 44.2 | 43.6 | 0.61 | 1 | 2.18 |
| 44.4 | 43 | 0.57 | 44.3 | 43.3 | 0.53 | 44.1 | 43.7 | 0.55 | 2 | |
| 44.3 | 43.9 | 0.63 | 44.2 | 44 | 0.6 | 44.2 | 43.9 | 0.62 | 3 | |
| 44.4 | 43.7 | 0.6 | 44.3 | 43.7 | 0.5 | 44.2 | 43.7 | 0.6 | Avg | |
| Sam-Sample 10 | 0.0106" Finish Gauge Continuous Anneal Quenched | | | | | | | | | |
| 44.1 | 44.1 | 0.57 | 44.5 | 44.1 | 0.39 | 43.9 | 43.4 | 0.57 | 1 | 2.11 |
| 44.7 | 43.9 | 0.61 | 45 | 44 | 0.57 | 44.4 | 43.2 | 0.55 | 2 | |
| 44.3 | 43.5 | 0.54 | 44.2 | 44 | 0.67 | 44.2 | 44.1 | 0.54 | 3 | |
| 44.4 | 43.8 | 0.6 | 44.6 | 44.0 | 0.5 | 44.2 | 43.6 | 0.6 | Avg | |

Comparing sample 5 with samples 6 and 7 and sample 8 with samples 9 and 10 in Table III, a continuous intermediate anneal provides a higher yield tensile strength and ultimate tensile strength compared to a batch intermediate anneal. A continuous intermediate anneal also provides a higher earing than and comparable elongation to a batch intermediate anneal. For samples 6 and 7 and 9 and 10, it can be readily seen that a transflux induction heater provides more uniformity in physical properties throughout the cross-section of the strip and along the length of the strip compared to a batch anneal furnace. This is believed to be due to the more uniform heating caused by a transflux induction heater compared to a radiant batch furnace. Comparing samples 6 and 7 and samples 9 and 10, the yield tensile strength, elongation, ultimate tensile strength, and earing are comparable for quenched and unquenched samples. Accordingly, quenching appears to have no significant impact on mechanical properties.

EXAMPLE 3

Further tests were conducted to compare end stock produced by a variety of processes including the process of the present invention. Table IV below sets forth the sample sheet compositions and fabrication processes.

TABLE IV

| | Composition | | | | | | | Hot Mill | Anneal | Cold | | Final | | | Buckle Strength (ksi) | |
|---|---|---|---|---|---|---|---|---|---|---|---|---|---|---|---|---|
| Sample No. | Mg (%) | Mn (%) | Si (%) | Cu (%) | Fe (%) | Tip Size | Heater? | Gauge (Inch) | Temp. (°F.) | Mill Passes | Stabilize Anneal | Gauge (Inches) | UTS (ksi) | YTS (ksi) | As Made | After 4 Weeks |
| 11 | 4.4 | 0.2 | 0.1 | 0.1 | 0.2 | 19 mm | Y at 800° F. | 0.075 | N/A | 2 | N/A | 0.0108 | 58.67 | 50.50 | 101.74 | 96.57 |
| 12 | 4.4 | 0.2 | 0.1 | 0.1 | 0.2 | 19 mm | Y at 800° F. | 0.075 | N/A | 2 | N/A | 0.0108 | 58.77 | 52.05 | 99.16 | 96.36 |
| 13 | 4.9 | 0.2 | 0.1 | 0.1 | 0.2 | 17.5 mm | Y at 800° F. | 0.075 | N/A | 2 | N/A | 0.0108 | 57.90 | 49.98 | 100.46 | 97.72 |
| 14 | 4.9 | 0.2 | 0.1 | 0.1 | 0.2 | 19 mm | Y at 800° F. | 0.075 | N/A | 2 | N/A | 0.0108 | 55.90 | 47.74 | 97.11 | 92.2 |
| 15 | 4.9 | 0.2 | 0.1 | 0.1 | 0.2 | 19 mm | N | 0.075 | N/A | 3 | N/A | 0.0108 | 56.99 | 49.22 | 98.57 | 95.44 |
| 16 | 4.9 | 0.2 | 0.1 | 0.1 | 0.2 | 19 mm | N | 0.075 | 725° F./3 hrs. | 3 | N/A | 0.0108 | 55.09 | 45.88 | 95.41 | 92.31 |
| 17 | 4.9 | 0.2 | 0.1 | 0.1 | 0.2 | 19 mm | Y at 800° F. | 0.075 | N/A | 2 | N/A | 0.0108 | 56.55 | 49.68 | 97.01 | 93.96 |
| 18 | 4.9 | 0.2 | 0.1 | 0.1 | 0.2 | 19 mm | Y at 800° F. | 0.075 | N/A | 2 | N/A | 0.0108 | 55.96 | 48.31 | 97.62 | 92.93 |
| 19 | 4.9 | 0.2 | 0.1 | 0.1 | 0.2 | 19 mm | Y at 800° F. | 0.075 | N/A | 2 | N/A | 0.0108 | 55.09 | 47.40 | 96.68 | 93.04 |
| 20 | 4.4 | 0.2 | 0.1 | 0.1 | 0.2 | 19 mm | Y at 800° F. | 0.075 | N/A | 2 | 350° F/3 hrs. | 0.001 | 57.7 | 49.6 | | |
| 21 | 4.4 | 0.2 | 0.1 | 0.1 | 0.2 | 19 mm | Y at 800° F. | 0.075 | N/A | 2 | 350° F/3 hrs. | 0.001 | 57.5 | 50.2 | | |
| 22 | 4.8 | 0.2 | 0.1 | 0.1 | 0.2 | 19 mm | N | 0.075 | 725° F/3 hrs. | 2 | 350° F.) 3 hrs. | 0.011 | 58.6 | 51.1 | | |
| 23 | 4.9 | 0.2 | 0.1 | 0.08 | 0.2 | 19 mm | N | 0.11 | 725° F/3 hrs. | 3 | N/A | 0.0108 | 57 | 49.2 | 98.6 | 95.4 |
| 24 | 4.9 | 0.2 | 0.1 | 0.08 | 0.2 | 19 mm | N | 0.11 | 725° F/3 hrs. | 3 | N/A | 0.0108 | 55.1 | 48.9 | 95.4 | 92.3 |
| 25 | 4.9 | 0.2 | 0.1 | 0.07 | 0.2 | 19 mm | Y at 800° F. | 0.08 | N/A | 2 | N/A | 0.0108 | 55.9 | 47.7 | 97.1 | 92.2 |
| 26 | 4.9 | 0.2 | 0.1 | 0.08 | 0.2 | 17 mm | Y at 800° F. | 0.08 | N/A | 2 | N/A | 0.0108 | 57.9 | 50 | 100.5 | 97.7 |
| 27 | 5.0 | 0.3 | 0.1 | 0.08 | 0.3 | 19 mm | Y at 800° F. | 0.08 | N/A | 2 | N/A | 0.0108 | 58.8 | 52.1 | 99.2 | 96.4 |
| 23 (Comparative) | U | U | U | U | U | U | N | N/A | N/A | N/A | N/A | 55.74 | 50.37 | 96.8 | 93.8 | |

The ultimate and yield tensile strengths and buckle strengths (or dome reversal strength) of the samples were determined. The buckle strength was also determined after 4 weeks following manufacture. As can be seen from Table IV, the buckle strength experienced less decrease after four weeks for samples fabricated using a heater prior to hot milling compared to sample 15 which was fabricated without heating prior to hot rolling. However, in some cases, the decrease in buckle strength over a four-week period was roughly the same for heated versus unheated samples.

TABLE V

| Sample No. | Si (wt %) | Fe (wt %) | Cu (wt %) | Mn (wt %) | Mg (wt %) |
|---|---|---|---|---|---|
| 29 | 0.39 | 0.538 | 0.404 | 1.06 | 1.333 |
| 30 | 0.383 | 0.532 | 0.4 | 1.058 | 1.316 |
| 32 | 0.394 | 0.546 | 0.405 | 1.064 | 1.334 |
| 39 | 0.421 | 0.57 | 0.419 | 1.045 | 1.335 |
| 40 | 0.39 | 0.547 | 0.405 | 1.064 | 1.334 |
| 44 | 0.395 | 0.541 | 0.405 | 1.061 | 1.336 |
| 34 | 0.392 | 0.551 | 0.408 | 1.073 | 1.339 |
| 35 | 0.379 | 0.538 | 0.398 | 1.048 | 1.303 |
| 36 | 0.397 | 0.554 | 0.409 | 1.054 | 1.322 |
| 37 | 0.388 | 0.543 | 0.403 | 1.063 | 1.337 |
| 38 | 0.386 | 0.542 | 0.404 | 1.076 | 1.334 |
| 31 and 41–43 | 0.387 | 0.562 | 0.463 | 1.055 | 1.339 |

TABLE VI

| Sample No. | HM gauge (Inches) | Heater on/off | Hot Mill Anneal | CM Pass | Batch Anneal | Intermediate CM Pass | Anneal Batch/ TFIH | Finish gauge (Inches) |
|---|---|---|---|---|---|---|---|---|
| 29 | 0.105 | off | none | .062" | yes/825° F. | .025" | Batch | 0.0112 |
| 30 | 0.105 | off | none | .062" | yes/825° F. | .025" | Batch | 0.0112 |
| 31 | 0.105 | Not available | none | .062" | yes/825° F. | .025" | Batch | 0.0112 |
| 32 | 0.105 | off | none | .062" | yes/825° F. | .025" | TFIH | 0.0112 |
| 31 | 0.105 | Not available | none | .062" | yes/825° F. | .025" | TFIH | 0.0112 |
| 39 | 0.105 | off | yes/825° F. | .050" | no | .025" | Batch | 0.0112 |
| 40 | 0.105 | off | yes/825° F. | .050" | no | .025" | Batch | 0.0112 |
| 41 | 0.105 | Not available | yes/825° F. | .045" | no | .025" | Batch | 0.0112 |
| 41 | 0.105 | Not available | yes/825° F. | .045" | no | .025" | Batch | 0.0112 |
| 44 | 0.105 | off | yes/825° F. | .050" | no | .025" | TFIH | 0.0112 |
| 42 | 0.105 | Not available | yes/825° F. | .045" | no | .025" | TFIH | 0.0112 |
| 34 | 0.065 | on | none | none | none | .025" | Batch | 0.0112 |
| 35 | 0.065 | on | none | none | none | .025" | TFIH | 0.0112 |
| 36 | 0.105 | on | none | .050" | none | .025" | Batch | 0.0112 |
| 37 | 0.105 | on | none | .050" | none | .025" | Batch | 0.0112 |
| 38 | 0.105 | on | none | .050" | none | .025" | TFIH | 0.0112 |

EXAMPLE 4

Further tests were conducted to compare sheet produced by a variety of processes including the process of the present invention. The goals of the tests included: (i) determine the feasibility of replacing the hot mill batch anneal using a solenoidal heater located in front of the first hot mill stand to cause self-annealing of the strip after hot milling is complete; (ii) determine the feasibility of replacing the intermediate batch anneal with a continuous anneal using a transflux induction heater (TFIH); and (iii) confirm prior test results that it is possible to eliminate one cold mill pass and hot mill anneal by exiting the hot mill at 0.065 inch gauge. Referring to Tables V and VI, samples 29–31, 32–33, 34, 35, 36–37, 38, 39–42, and 43–44 are sample groupings based on the process used to produce the sample. As used in Table VI, "TFIH" refers to a transflux induction heater, "Heater" refers to a continuous solenoidal heater, and "Batch" refers to a batch gas fired heater. The chemical weight percent compositions of the samples are shown in Table V. The composition is the same as that for body stock. The continuous anneal test results, namely earing, ultimate tensile strength, yield tensile strength, and elongation, and process used to produce coils from the samples are presented in Table VI for each sample.

For samples 34–38, a solenoidal heater was located before the first stand of the hot mill. The heater raised the tab temperature a maximum of 160° F. at a casting speed of 16.4 fpm and a slab thickness of 19.0 mm. Table XI illustrates test results for coils produced utilizing this process configuration.

The solenoidal heater was found to have the following advantages: (i) at lower gauges of the cast strip, elimination of the need for a hot mill anneal at 825° F. for 3 hours; (ii) reduction of the hot mill stand amps and loads when the exit gauge from the hot mill is reduced; (iii) increase in the amount of heat transferred to the cast strip when the cast strips are thinner than 19 mm (i.e., thinner cast strips cool more quickly, which can increase the loads and amps and therefore limit the exit gauge that can be realized without applying excessive power to the hot mill); and (iv) removal of striations in the hot mill strip.

As shown in Table XI, Samples 36–38 produced using the solenoidal heater at the hot mill exit gauge of 0.105-inch gauge were undesirable. Microstructure confirmed that the coils produced using this exit gauge did not recrystallize. This is further confirmed in the final gauge earing/mechanical property data. While not wishing to be bound by any theory, it is believed that the cast strip gauge is too thick for the amount of time available in the solenoidal heater and the power usage. This, in combination with the chemistry of the samples, complicates recrystallization. Another reason could be the higher intrastand gauge of 0.22 mm versus 0.19 mm seen on the 0.65-inch gauge material. The higher intrastand gauge and intrastand temperature maintained the cast strip above the temperature above the recrystallization point before the second hot mill stand.

In the case of coils fabricated using the solenoidal heater and an exit gauge of 0.65 inch, the material reacted as a self-anneal hotband and recrystallized. Referring to Tables XI and XII, for example, Samples 29 and 34 both recrystallized. Sample 29, which was fabricated without the solenoidal heater, exited the hot mill at 0.105-inch gauge and was cold rolled to 0.062-inch gauge. It then received a batch anneal at 825° F. for 3 hours of soak time, which caused recrystallization. The total anneal cycle time was 12 to 18 hours of soak time. In contrast, Sample 34 exited the hot mill at 0.065-inch gauge with the solenoidal heater at 30% of available power. Sample 34 received no batch anneal after the first cold rolling pass. Unlike Sample 29, which received three cold mill passes, Sample 34 received only two cold mill passes. The data illustrates that when both samples were given a batch anneal at 0.025-inch gauge after the second cold rolling pass and before the finished cold rolling pass, there was a very minor difference in properties.

In short, the minor difference in properties indicates that a solenoidal heater could be placed in front of the hot mill and, using an exit gauge of 0.65 inches or lower, a cold mill pass and the hot mill anneal could both be eliminated while maintaining acceptable properties.

Regarding the comparison of an intermediate batch anneal against an intermediate continuous anneal using an induction heater, Tables VI through XII present the results. The pilot line using the transflux induction heater could only accept a 14.5-inch wide strip and was limited to a maximum of 1,000 lbs. of incoming weight. The TFIH anneal temperature was 950° F. as compared to 705° F. for the batch anneal. The reason for the temperature difference is due to the total exposure time which is considerably less for the TFIH compared to the batch anneal. The total exposure time of the strip in the TFIH was about 2–6 seconds.

It is evident from the Tables that the final earing is aggravated by the use of a continuous intermediate anneal as compared to a batch anneal. The magnitude of the earing varied, depending upon the process used to produce the material.

Figure 9:
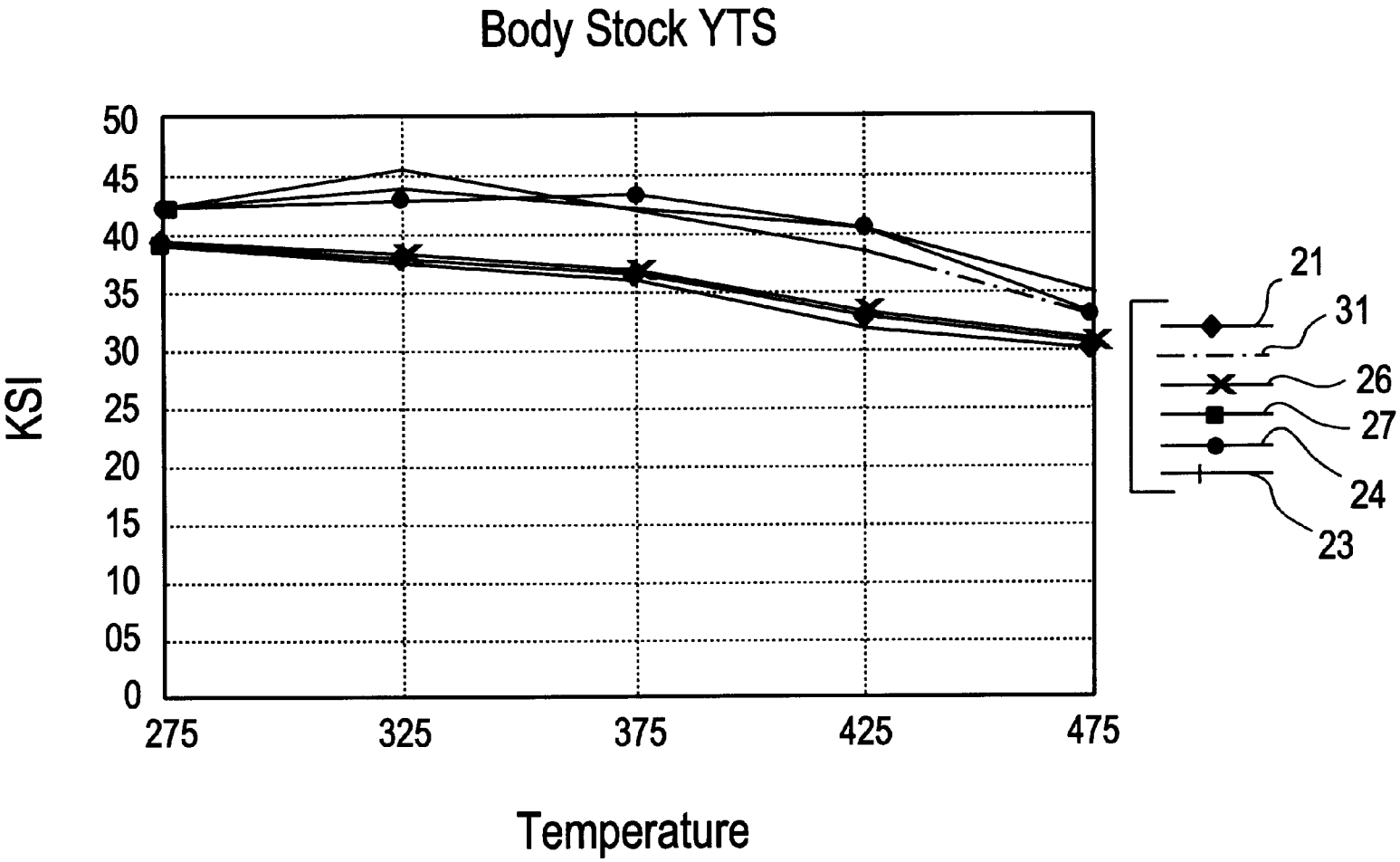
FIGS. 9 and 10 depict test results for various samples.
Figure 10:
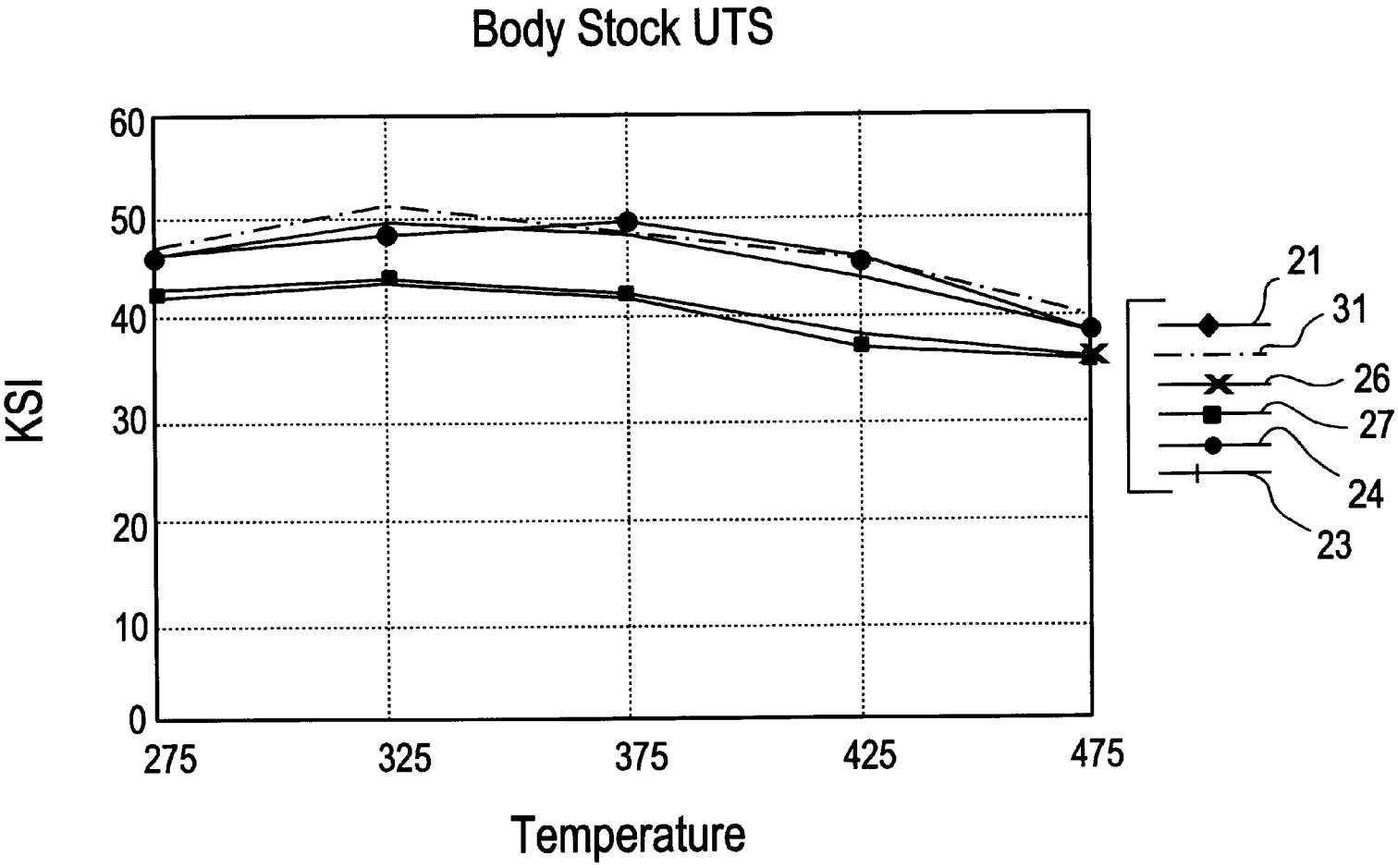

The TFIH increases the as-rolled mechanical properties of the sheet by an average of about 3.0 ksi in tensile strength and 3.5 ksi in yield strength. An important issue is the increase of tensile and yield strengths when the TFIH coils are subjected to further heating. Normally when as-rolled material is heated in the temperature range of 3250 to 400° F., the mechanical properties will be decreased significantly in yield strength and slightly in the tensile strength and increased in percent elongation. In the case of the coils produced by a process using a TFIH, tensile and yield strengths and percent elongation are increased as the coils are heated. This phenomena is illustrated in Table XI and FIGS. 9 and 10. The increase in tensile and yield strengths from heating is as much as 5 ksi with a 325° F./1 hour stabilize anneal and 7 ksi with an after-bake temperature of 400° F. for 10 minutes. The increase continues until a stabilized temperature of about 400° F. is realized.

TABLE VII

| | If "0" heater is | | Heater | Heater | | | | | | | Hot Mill | |
|---|---|---|---|---|---|---|---|---|---|---|---|---|
| | off | Caster | Entry | Exit | Interstand | Hot Mill | Hot Mill | | Hot Mill | | Stand 1 | Stand 2 |
| Sample No. | Heater KW* | Exit Temp (° F.) | Temp (° F.) | Temp (° F.) | Temp (° F.) | Exit Temp (° F.) | Stand 1 Amps | Stand 2 Amps | Stand 1 Load | Stand 2 Load | Gauge (Inches) | Gauge (Inches) |
| 45 | 0 | 1030 | 935 | 904 | 775 | 655 | 1460 | 1290 | 1018 | 970 | 0.225 | 0.105 |
| 46 | 40 | 1025 | 940 | 1004 | 798 | 645 | 1350 | 1210 | 890 | 911 | 0.23 | 0.105 |
| 47 | 30 | 1023 | 958 | 954 | 794 | 717 | 1420 | 1440 | 998 | 1070 | 0.19 | 0.065 |
| 48 | 30 | 1030 | 953 | 959 | 801 | 700 | 1400 | 1460 | 1085 | 1024 | 0.19 | 0.065 |
| 49 | 40 | 1040 | 970 | 984 | 803 | 658 | 1300 | 1210 | 898 | 951 | 0.19 | 0.065 |
| 50 | 40 | 1039 | 963 | 989 | 80a | 652 | 1290 | 1220 | 870 | 943 | 0.22 | 0.105 |
| 51 | 40 | 1034 | 960 | 999 | 799 | 655 | 1280 | 1220 | 696 | 947 | 0.22 | 0.105 |
| 52 | 0 | 1015 | 948 | 911 | 750 | 647 | 1480 | 1250 | 1010 | 982 | 0.22 | 0.105 |
| 53 | 0 | | | 905 | 768 | 652 | 1500 | 1280 | 1049 | 981 | 0.22 | 0.105 |
| 54 | 0 | | 958 | 910 | 767 | 647 | 1490 | 1250 | 1029 | 970 | 0.22 | 0.105 |
| 55 | 0 | | 952 | 908 | 767 | 650 | 1490 | 1260 | 1032 | 985 | 0.22 | 0.105 |
| 56 | 0 | | 960 | 910 | 766 | 645 | 1480 | 1250 | 1022 | 980 | 0.22 | 0.105 |

Caster Speed was 16.4 feet per minute.
Caster tip size was 19 millimeters.

TABLE VIII

| | | As rolled | | | 325/hr | | | 4OO/1O | | | Intermediate |
|---|---|---|---|---|---|---|---|---|---|---|---|
| Sample No. | Finish Ga Earing (%) | Uts (ksi) | YTS (ksi) | EI (%) | UTS (ksi) | YTS (ksi) | EI (%) | UTS (ksi) | YTS (ksi) | EI (%) | Anneal Type |
| 36 | 2.53 | 43.34 | 41.62 | 2.67 | 44.71 | 39.64 | 5.41 | 43.55 | 37.81 | 5.45 | Batch |
| 37 | 2.88 | 43.62 | 41.83 | 3.14 | 44.69 | 39.91 | 4.69 | 43.2 | 37.94 | 5.5 | Batch |
| Average | 2.71 | 43.48 | 41.73 | 2.91 | 44.70 | 39.78 | 5.05 | 43.38 | 37.88 | 5.48 | |
| | Earing (%) | | | | | | | | | | |
| 34 | 1.72 | 41.94 | 40.12 | 3.26 | 43.71 | 38.6 | 5.58 | 42.47 | 36.9 | 5.48 | Batch |

TABLE VIII-continued

| | | As rolled | | | 325/hr | | | 4OO/1O | | | Intermediate |
|---|---|---|---|---|---|---|---|---|---|---|---|
| Sample No. | Finish Ga Earing (%) | Uts (ksi) | YTS (ksi) | EI (%) | UTS (ksi) | YTS (ksi) | EI (%) | UTS (ksi) | YTS (ksi) | EI (%) | Anneal Type |
| 35 | 2.66 | 45.06 | 44.53 | 2.43 | 50.42 | 44.48 | 7.87 | 49.95 | 44.19 | 7.6 | TFIH |
| Diff Samples 34 & 35 | 0.94 | 3.12 | 4.41 | −0.83 | 6.71 | 5.88 | 2.29 | 7.48 | 7.29 | 2.12 | |

TABLE IX

| | Finish Ga | Surface | As rolled | | | 325/1 hr. | | | 400/10 | | | 2nd Anneal | |
|---|---|---|---|---|---|---|---|---|---|---|---|---|---|
| Sample No. | Earing (%) | Grain Rating | Uts (ksi) | YTS (ksi) | EI (%) | Uts (ksi) | YTS (ksi) | EI (%) | Uts (ksi) | YTS (ksi) | EI (%) | Gauge (Inches) | Type |
| 29 | 1.76 | 3 | 42.8 | 40.78 | 3.63 | 44.19 | 38.84 | 5.35 | 42.75 | 36.89 | 5.78 | 0.025 | Batch |
| 30 | 1.97 | 2.25 | 42.25 | 40.54 | 3.49 | 43.97 | 38.54 | 5.39 | 42.55 | 36.65 | 6.08 | 0.025 | Batch |
| Average 29 & 30 | 1.865 | 2.625 | 42.53 | 40.66 | 3.56 | 44.08 | 38.69 | 5.37 | 42.65 | 36.77 | 5.93 | | |
| 31 | 1.35 | 1.5 | 41.91 | 39.6 | 3.6 | 43.41 | 38.19 | 5.34 | 42.1 | 36.91 | 5.63 | 0.025 | Batch |
| Diff Average 29 & 30 and Sample 31 | −0.515 | −1.125 | −.062 | −1.06 | 0.04 | −0.67 | −0.5 | −0.03 | −0.55 | 0.14 | −0.3 | | |
| 32 | 2.06 | 6 | 45.09 | 43.97 | 2.49 | 49.23 | 43.04 | 7.2 | 47.51 | 41.1 | 7.01 | 0.025 | TFIH |
| 33 | 2.14 | 5 | 44.54 | 43.61 | 2.5 | 48.57 | 42.8 | 6.85 | 48.47 | 42.66 | 7.12 | 0.025 | TFIH |
| Average 32 & 33 | 2.1 | 5.5 | 44.82 | 43.79 | 2.495 | 48.9 | 42.92 | 7.025 | 47.99 | 41.88 | 7.065 | | |
| Diff Samples 32 & 33 | 0.08 | −1 | −0.55 | −0.36 | 0.01 | −0.24 | −0.35 | −0.35 | 0.96 | 1.56 | 0.11 | | |
| Diff Average 29 & 30 and Sample 32 | 0.195 | 3.375 | 2.565 | 3.31 | −1.07 | 5.15 | 4.35 | 1.83 | 4.86 | 4.33 | 1.08 | | |
| Diff Samples 31 and 32 | 0.79 | 3.5 | 2.63 | 4.01 | −1.1 | 5.16 | 4.61 | 1.51 | 6.37 | 5.75 | 1.49 | | |

TABLE X

| | Finish Ga | Surface | As rolled | | | 325/1 hr. | | | 400/10 | | | 2nd Anneal | |
|---|---|---|---|---|---|---|---|---|---|---|---|---|---|
| Sample No. | Earing (%) | Grain Rating | Uts (ksi) | YTS (ksi) | EI (%) | Uts (ksi) | YTS (ksi) | EI (%) | Uts (ksi) | YTS (ksi) | EI (%) | Gauge (Inches) | Type |
| 39 | 1.61 | 3.5 | 41.87 | 40.08 | 3.2 | 43.63 | 38.85 | 5.23 | 42.16 | 36.52 | 5.37 | 0.025 | Batch |
| 39 | 1.61 | 3.5 | 41.87 | 40.08 | 3.2 | 43.63 | 38.85 | 5.23 | 42.16 | 36.52 | 5.37 | 0.025 | |
| 40 | 1.68 | 3.5 | 42.17 | 40.59 | 2.86 | 44.05 | 38.67 | 5.97 | 42.86 | 36.95 | 5.91 | 0.025 | |
| Average Samples 39 & 40 | 1.65 | 3.50 | 42.02 | 40.34 | 3.03 | 43.64 | 38.76 | 5.60 | 42.51 | 36.74 | 5.64 | | |
| 41 | 1.78 | 4 | 42.18 | 40.58 | 3.34 | 44.22 | 39.01 | 5.74 | 43.04 | 37.23 | 5.84 | 0.025 | |
| 42 | 2.14 | 3.5 | 42.45 | 40.84 | 3.17 | 44.46 | 39.1 | 5.69 | 43.22 | 37.44 | 5.84 | 0.025 | |
| Average Samples 41 & 42 | 1.96 | 3.75 | 42.32 | 40.71 | 3.255 | 44.34 | 39.06 | 5.715 | 43.13 | 37.34 | 5.84 | | |
| 43 | 2.58 | 8 | 45.3 | 44.14 | 2.46 | 48.32 | 42.96 | 6.37 | 47.46 | 41.86 | 6.81 | 0.02 | |
| 44 | 2.58 | 8 | 45.15 | 44.11 | 3.17 | 49.02 | 43 | 6.87 | 48.06 | 42.24 | 7.23 | 0.02 | |
| Diff Sample 44 and Average Samples 38 & 40 | 0.93 | 4.5 | 3.13 | 3.78 | 0.14 | 5.18 | 4.24 | 1.27 | 5.55 | 5.51 | 1.59 | | |
| Diff Sample 43 and Average Samples 34 & 35 | 0.62 | 4.25 | 2.985 | 3.43 | −0.8 | 3.98 | 3.905 | O.655 | 4.33 | 4.525 | 0.97 | | |

TABLE XI

| | Finish Ga | Surface | As rolled | | | 325/1 hrs. | | | 400/10 | | | | 1st ANNEAL | | | | | 2nd (INTERMEDIATE) ANNEAL | | | |
|---|---|---|---|---|---|---|---|---|---|---|---|---|---|---|---|---|---|---|---|---|---|
| Sample # | Earing (%) | Grain Heating | Uts (ksi) | YTS (ksi) | EI (%) | Uts (ksi) | YTS (ksi) | EI (%) | Uts (Ksi) | YTS (ksi) | EI (%) | Heater | HMGA (In) | GA (In) | TYPE | TEMP (° F.) | TIME ((Hrs. 3 | GA (In.) | TYPE | TEMP (° F.) | TIME (Hrs) |
| 29 | 1.76 | 3 | 42.8 | 40.78 | 3.63 | 4.19 | 38.84 | 6.35 | 42.76 | 36.89 | 5.78 | N/A | 0.105 | 0.082 | Batch | 825 | 3 | 0.025 | Batch | 705 | 13 hrs. |
| 30 | 1.97 | 2.25 | 42.25 | 40.54 | 3.49 | 43.87 | 38.54 | 5.39 | 42.55 | 36.55 | 6.08 | N/A | 0.105 | 0.062 | Batch | 825 | 3 | 0.025 | Batch | 705 | 13 hrs. |
| 31 | 1.35 | 1.5 | 41.91 | 39.6 | 3.6 | 43.41 | 38.18 | 5.34 | 42.1 | 36.81 | 5.63 | N/A | 0.105 | 0.062 | Batch | 825 | 3 | 0.025 | Batch | 705 | 13 hrs. |
| 32 | 2.06 | 6 | 45.09 | 43.97 | 2.49 | 49.23 | 43.04 | 7.2 | 47.51 | 41.1 | 7.01 | N/A | 0.105 | 0.062 | Batch | 825 | 3 | 0.025 | TRH | 950 | 2 sec. |
| 33 | 2.14 | 5 | 44.54 | 43.61 | 2.5 | 48.57 | 42.8 | 6.85 | 48.47 | 42.66 | 7.12 | N/A | 0.105 | 0.062 | Batch | 825 | 3 | 0.025 | TRH | 950 | 2 sec. |
| 34 | 1.72 | 3 | 41.94 | 40.12 | 3.26 | 43.71 | 38.6 | 5.56 | 42.47 | 36.9 | 5.48 | Y | 0.065 | 0.065 | N/A | 800 | ? | 0.025 | Batch | 705 | 13 hrs. |
| 35 | 3.04 | 7 | 45.06 | 44.53 | 2.43 | 50.42 | 44.48 | 7.87 | 49.95 | 44.19 | 7.6 | Y | 0.065 | 0.065 | N/A | 800 | ? | 0.025 | TFtH | 950 | 2 sec. |
| 36 | 2.53 | 2.5 | 43.34 | 41.62 | 2.67 | 44.71 | 39.64 | 5.41 | 43.55 | 37.81 | 5.45 | Y | 0.105 | 0.105 | N/A | 800 | ? | 0.025 | Batch | 705 | 13 hrs. |
| 37 | 3.36 | 2.25 | 43.62 | 41.83 | 3.14 | 44.69 | 39.91 | 4.09 | 43.2 | 37.94 | 5.5 | Y | 0.105 | 0.105 | N/A | 800 | ? | 0.025 | Batch | 705 | 13 hrs. |
| 38 | 2.41 | 8 | 47.24 | 45.46 | 3.95 | 52.16 | 46.36 | 8.19 | 50.01 | 44.56 | 7.94 | Y | 0.105 | 0.105 | N/A | 800 | ? | 0.025 | TRH | 950 | 2 sec. |
| 39 | 1.81 | 3.5 | 41.87 | 40.08 | 3.2 | 43.63 | 38.85 | 5.23 | 42.16 | 36.52 | 5.37 | N/A | 0.105 | 0.105 | Batch | 825 | 3 | 0.025 | Batch | 705 | 13 hrs. |
| 40 | 1.68 | 3.5 | 42.17 | 40.59 | 2.86 | 44.05 | 38.67 | 5.97 | 42.86 | 38.95 | 5.91 | N/A | 0.105 | 0.105 | Batch | 825 | 3 | 0.025 | Batch | 705 | 13 hrs. |
| 41 | 1.76 | 4 | 42.18 | 40.58 | 3.34 | 44.22 | 39.01 | 5.74 | 43.04 | 37.23 | 5.84 | N/A | 0.105 | 0.105 | Batch | 825 | 3 | 0.025 | Batch | 705 | 13 hrs. |
| 42 | 2.14 | 3.5 | 42.45 | 40.84 | 2.17 | 44.46 | 39.1 | 5.69 | 43.22 | 37.44 | 5.84 | N/A | 0.105 | 0.105 | Batch | 825 | 3 | 0.025 | Batch | 705 | 13 hrs. |
| 43 | 2.58 | 8 | 45.3 | 44.14 | 2.46 | 48.32 | 42.96 | 8.37 | 47.46 | 41.88 | 6.81 | N/A | 0.105 | 0.105 | Batch | 825 | 3 | 0.025 | TRH | 950 | 2 sec. |
| 44 | 2.58 | 8 | 45.15 | 44.11 | 3.17 | 49.02 | 43 | 6.67 | 48.06 | 42.24 | 7.23 | N/A | 0.105 | 0.105 | Batch | 825 | 3 | 0.025 | TRH | 950 | 2 sec. |

TABLE XII

| | Ultimate Tensile Strength (ksi) | | | | | Yield Tensile Strength (ksi) | | | | |
|---|---|---|---|---|---|---|---|---|---|---|
| Sample No. | 275° F. | 325° F. | 375° F | 425° F. | 425° F. | 275° F. | 325° F. | 375° F. | 425° F. | 475° F. |
| 29 | 43.08 | 43.92 | 42.87 | 38.41 | 38.08 | 39.62 | 38.61 | 36.95 | 33.19 | 30.73 |
| 30 | 42.38 | 43.22 | 42.23 | 37.63 | 35.8 | 39.11 | 38.04 | 38.56 | 32.17 | 30.08 |
| 31 | 42.28 | 43.23 | 42.37 | 37.88 | 35.9 | 38.97 | 38.03 | 38.63 | 32.58 | 30.09 |
| 34 | 42.6 | 43.71 | 42.64 | 39.5 | 39.39 | 39.47 | 38.59 | 37.11 | 33.54 | 31.1 |
| 35 | 47.58 | 51.53 | 48.24 | 46.2 | 40.28 | 43.86 | 45.72 | 42.63 | 41.23 | 35.45 |
| 37 | 48.54 | 49.02 | 49.7 | 48.27 | 38.88 | 42.68 | 43.03 | 43.68 | 40.84 | 33.2 |
| 31 | 40.02 | 49.66 | 40.51 | 44.27 | 38.84 | 43.02 | 44.08 | 42.73 | 35.82 | 33.34 |

| | % Elongation | | | | | Earing (%) | | |
|---|---|---|---|---|---|---|---|---|
| Sample No. | 275° F. | 325° F. | 375° F. | 425° F. | 475° F. | 275° F. | 325° F. | 425° F. |
| 29 | 4.06 | 5.42 | 5.53 | 4.99 | 4.86 | 1.98 | 1.86 | 1.97 |
| 39 | 4.29 | 5.8 | 6.95 | 5.67 | 6.74 | 2.68 | 1.7 | 1.85 |
| 31 | 3.74 | 5.41 | 5.67 | 5.57 | 6.64 | 1.4 | 1.48 | 1.43 |
| 34 | 3.98 | 5.35 | 5.95 | 5.08 | 5.6 | 1.95 | 2.18 | 2.02 |
| 35 | 6.14 | 7.64 | 7.26 | 6.02 | 5.14 | 2.65 | 3.25 | 2.47 |
| 37 | 4.89 | 6.86 | 7.7 | 6.42 | 6.27 | 2.23 | 2.68 | 2.32 |
| 31 | 4.91 | 7.05 | 7.07 | 6.4 | 5.35 | 2.45 | 2.26 | 2.2 |

Based upon the foregoing, the test results indicate that: (i) one cold mill pass and the hot mill anneal can be eliminated by introducing a solenoidal heater and exit strip gauge of 0.65 inch or less with an intermediate batch anneal; and (ii) the TFIH used at the intermediate anneal point (with a 55% final reduction) increases the final earing by at least 0.6%, which is not acceptable. The same process, when introduced to temperatures of 325 to 400° F. increases the overall mechanical properties (i.e., tensile and yield strengths) by 5 to 7 ksi which also is not acceptable in a can plant where the IBO and deco ovens would, in fact, make the can too strong to be necked and flanged.

EXAMPLE 5

Further tests were performed to evaluate a process utilizing a solenoidal heater before the first hot mill stand and either two or three cold mill passes with no hot mill anneal. As shown in Tables XIII and XIV, the test established that the use of a solenoidal heater in two cold mill passes was a superior process. Sample 58 had a slightly superior tab strength (T. S.) and equal or better tab bend than Samples 60 and 61. Sample 58 has a similar tab strength to the comparative sample. All variables ran relatively cleanly as evidenced by a grading system based on the degree or frequency of burrs in the lanced holes in the progressions (see Table XIII).

The tests further show that the magnesium content of the alloy can be lowered while still retaining acceptable properties for canmaking. As used in the tables, "CM" refers to cold mill.

TABLE XIII

| Sample No. | Description | Tab Strength (lbs.) | Tab Bends (lbs.) |
|---|---|---|---|
| 57 | 4.9% Mg 3-CM | 6.8–7.3 | 6.5–7.0 |
| 58 | Passes | 7.0–7.2 | 6.5–8.0 |
| 59 | *4.9% Mg 2-CM | 6.9–7.1 | 5.5–6.5 |
| 60 | Passes | 6.9–7.1 | 5.5–6.5 |
| | 4.5% Mg 2-CM | 6.5 | 4.0 |
| | Passes | | |
| | 4.9% Mg 3-CM | | |
| | Passes | | |
| | Minimum | | |

TABLE XIII-continued

| Sample No. | Description | Tab Strength (lbs.) | Tab Bends (lbs.) |
|---|---|---|---|
| 57 | 4.9% Mg 3-CM | 7.1–7.2 | 5.5–5.8 |
| 59 | Passes | 6.8–6.9 | 5.5–6.0 |
| 58 | 4.5% Mg 2-CM | 7.1–7.3 | 5.5–6.0 |
| 60 | Passes | 7.0–7.1 | 5.0–6.0 |
| | *4.9% Mg 2-CM | 6.5 | 4.0 |
| | Passes | | |
| | 4.9% Mg 3-CM | | |
| | Passes | | |
| | Minimum | | |
| 60 | 3-CM Passes | 7.0–7.1 | 6.0 |
| | Comparative | 7.1–7.25 | 6.0 |
| 61 | 3-CM Passes | 6.85–7.05 | 6.8–7.0 |
| | Comparative | 7.05–7.2 | 5.5–6.0 |

TABLE XIV

| Sample No. | Description | T.S. (ksi) | Y.S. (ksi) | Elong. (%) |
|---|---|---|---|---|
| 62 | 5182FE (4.40% Mg) | 57.7 | 49.6 | 7.3 |
| 63 | 5182FE (4.41% Mg) | 57.5 | 50.2 | 8.1 |
| 64 | 5182SP (4.91% Mg) | 58.6 | 51.0 | 7.4 |
| 65 | 5182SP (4.93% Mg) | 59.3 | 50.0 | 7.1 |

While various embodiments of the present invention have been described in detail, it is apparent that modifications and adaptations of those embodiments will occur to those skilled in the art. It is to be expressly understood that such modifications and adaptations are within the spirit and scope of the present invention.

What is claimed is:

1. A method for fabricating aluminum alloy sheet, comprising:

(a) continuously casting an aluminum alloy melt to form a cast strip;

(b) hot rolling the cast strip to form a hot rolled strip;

(c) cold rolling the hot rolled strip to reduce the thickness of the strip and form a partially cold rolled strip, wherein the cold rolling step (c) reduces the gauge of the hot rolled strip by a first total reduction;

(d) intermediate annealing in an induction heater the partially cold rolled strip at an intermediate annealing temperature to form an intermediate annealed cold rolled strip;

(e) further cold rolling the intermediate annealed cold rolled strip to form a cold rolled strip wherein the further cold rolling step (e) reduces the gauge of the partially cold rolled strip by a second total reduction, the first total reduction being more than the second total reduction and the second total reduction being less than about 55%; and (f) continuously imparting electromagnetic energy to the cold rolled strip in an induction furnace to form aluminum alloy sheet wherein at least one of the yield and ultimate tensile strengths is increased by the continuously imparting step.

2. The method of claim 1, and excluding cold rolling of the aluminum alloy sheet after the continuously imparting step.

3. The method of claim 1, further comprising between the cold rolling step and continuously annealing step:

(e) contacting the cold rolled strip with a caustic cleaning solution to remove residue from the strip.

4. The method of claim 1, wherein the residence time of any portion of the cold rolled strip in the induction furnace ranges from about 2 to about 30 seconds.

5. The method of claim 1, wherein the temperature of the continuously imparting step ranges from about 148 to about 287° C.

6. The method of claim 1, wherein the cast strip has a cast output temperature and the hot rolling step (b) comprises heating the cast strip to a heated temperature in a heater, wherein the heater temperature exceeds the cast output temperature by at laest about 6° C.

7. The method of claim 6, wherein said heated temperature ranges from about 432 to about 565° C.

8. The method of claim 6, wherein the heater is a solenoidal furnace.

9. The method of claim 6, wherein the cast strip in the heating step has a gauge of no more than about 19 mm.

10. The method of claim 6, wherein the residence time of any portion of the cast strip in the heating step ranges from about 8 to about 30 seconds.

11. The method of claim 6, wherein the cold rolling step (c) is done in the absence of a hot mill anneal.

12. The method of claim 1, wherein the cast strip has a cast output temperature and the hot rolling step (b) comprises heating the cast strip to a heated temperature in a heater, wherein the heated temperature exceeds the cast output temperature by from about 6 to 52° C.

13. The method of claim 1, wherein the aluminum alloy melt comprises:

(i) from about 3.5 to about 4.9% by weight magnesium, (ii) from about 0.05 to about 0.5% by weight manganese, (iii) from about 0.05 to about 0.15% by weight copper, (iv) from about 0.05 to about 0.35% by weight iron, and (v) from about 0.05 to about 0.20% by weight silicon, the balance being aluminum and incidental additional materials and impurities.

14. The method of claim 13, wherein said aluminum alloy sheet has an as-rolled yield strength of at least about 41 ksi.

15. The method of claim 13, wherein said aluminum alloy sheet has an as-rolled tensile strength of at least about 49 ksi.

16. The method of claim 13, wherein said aluminum alloy sheet has an elongation at break of at least about 3 percent.

17. The method of claim 13, further comprising forming the aluminum alloy sheet into tab stock and the tab stock has a tab strength of at least about 5 pounds.

18. The method of claim 13, further comprising forming the aluminum alloy sheet into tab stock.

19. The method of claim 1, wherein the hot rolling step comprises:

partially hot rolling the cast strip to form a partially hot rolled strip;

heating at least one of the cast strip and partially hot rolled strip to form a heated strip, wherein the at least one of the cast strip and partially hot rolled strip has a heater input temperature immediately before the heating step and the at least one of the cast strip and partially hot rolled strip is heated in the heating step to a heated temperature that is in excess of the heater input temperature; and further hot rolling the partially hot rolled strip to form the hot rolled strip.

20. The method of claim 1, wherein the hot rolling step is performed in the absence of solution heat treatment of the annealed cast strip.

21. The method of claim 1, wherein the hot rolling step reduces the gauge of the cast strip by at least about 80 percent.

22. The method of claim 1, wherein the hot rolled strip has a gauge ranging from about 0.065 to about 0.105 inches.

23. The method of claim 1, wherein the cast strip has a gauge ranging from about 10 to about 19 mm.

24. The method of claim 1, wherein the aluminum alloy melt comprises:

(i) from about 0.9 to about 1.5% by weight magnesium, (ii) from about 0.8 to about 1.2% by weight manganese, (iii) from about 0.05 to about 0.5% by weight copper, (iv) from about 0.05 to about 0.6% by weight iron, and (v) from about 0.05 to about 0.5% by weight silicon, the balance being aluminum and incidental additional materials and impurities.

25. The method of claim 1, wherein said aluminum alloy sheet has an as-rolled yield strength of at least about 38.5 ksi.

26. The method of claim 1, wherein said aluminum alloy sheet has an as-rolled tensile strength of at least about 43 ksi.

27. The method of claim 26, further comprising forming said aluminum alloy sheet into a container body and the container body has a column strength of at least about 90 psi.

28. The method of claim 26, further comprising forming said aluminum alloy sheet into body stock.

29. The method of claim 26, wherein a container produced from the aluminum alloy sheet has a dome reversal strength of at least about 180 psi.

30. The method of claim 23, wherein said aluminum alloy sheet has an elongation at break of at least about 3.5 percent.

31. The method of claim 1, wherein the hot rolling step comprises annealing the hot rolled strip.

32. The method of claim 1, further comprising directly after the continuously imparting step:

(a) contacting the cold rolled strip with a caustic cleaning solution to remove residue from the strip.

33. A method for fabricating aluminum alloy sheet, comprising:

(a) continuously casting an aluminum alloy melt to form a cast strip having a cast output temperature, wherein the aluminum alloy melt comprises;

(i) from about 0.9 to about 1.5% by weight magnesium, (ii) from about 0.8 to about 1.2% by weight manganese, (iii) no more than about 0.5% by weight copper, (iv) no more than about 0.6% by weight iron, and (v) no more than about 0.5% by weight silicon, the balance being aluminum and incidental additional materials and impurities;

(b) at least partially hot rolling the cast strip at a hot rolling temperature to reduce the thickness of the cast strip and form a hot rolled strip;

(c) heating at least one of the cast strip and hot rolled strip to a heated temperature in one of a solenoidal heater, infrared heater, induction heater, and gas-fired heater, wherein the heated temperature of the at least one of the cast strip and hot rolled strip ranges from about 399 to about 565° C.;

(d) partially cold rolling the hot rolled strip to form a partially cold rolled strip, wherein the partially cold rolling step reduces the gauge of the hot rolled strip by a first total reduction;

(e) annealing the partially cold rolled strip in an induction furnace by imparting electromagnetic energy to the partially cold rolled strip to form an intermediate annealed cold rolled strip;

(f) further cold rolling the intermediate annealed cold rolled strip to form a fully cold rolled strip, wherein the further cold rolling step reduces the gauge of the intermediate annealed cold rolled strip by a second total reduction;

(g) annealing the cold rolled strip in an induction furnace by imparting electromagnetic energy to the partially cold rolled strip to form aluminum alloy sheet wherein in annealing step (g), at least one of the yield strength and ultimate tensile strength of the cold rolled strip is increased and wherein the first total reduction is more than the second total reduction and the first total reduction is at least about 40%.

34. The method of claim 33, wherein the second total reduction is less than about 55%.

35. A method for fabricating aluminum alloy sheet, comprising:

(a) continuously casting an aluminum alloy melt to form a cast strip having a cast output temperature;

(b) partially hot rolling the cast strip at a hot rolling temperature to reduce the thickness of the cast strip and form a partially hot rolled strip;

(c) heating at least one of the cast strip and partially hot rolled strip to a heated temperature in one of a solenoidal heater, infrared heater, induction heater, and gas-fired heater, wherein the heated temperature ranges from about 399 to about 565° C.;

(d) further hot rolling the partially hot rolled strip after the heating step to form a hot rolled strip;

(e) cold rolling the hot rolled strip to form a partially cold rolled strip, wherein the cold rolling step reduces the gauge of the hot rolled strip by a first total reduction of at least about 40%;

(f) annealing the partially cold rolled strip in an induction furnace by imparting electromagnetic energy to the partially cold rolled strip to form an intermediate annealed cold rolled strip;

(g) further cold rolling the intermediate annealed cold rolled strip to form a cold rolled strip wherein the further cold rolling step reduces the gauge of the intermediate annealed cold rolled strip by a second total reduction that is less than the first total reduction; and (h) annealing the cold rolled strip to form aluminum alloy sheet, wherein at least one of the yield and ultimate tensile strengths of the cold rolled strip is greater than the at least one of the yield and ultimate tensile strengths of the cold rolled strip.

* * * * *

UNITED STATES PATENT AND TRADEMARK OFFICE

CERTIFICATE OF CORRECTION

PATENT NO. : 5,993,573
DATED : November 30, 1999
INVENTOR(S) : Selepack et al.

It is certified that error appears in the above-identified patent and that said Letters Patent is hereby corrected as shown below:

Column 32, claim 1,
Line 7, delete "the strip" and insert -- the hot rolled strip -- therefor.

Column 33,
Line 8, delete "partially" and insert -- intermediate annealed -- therefor.

Column 35,
Line 26, delete " the cold rolled strip" and insert -- the fully cold rolled strip -- therefor;
Line 27, delete " partially" and insert -- fully -- therefor;
Line 30, delete "the cold rolled strip" and insert -- the fully rolled strip -- therefor.

Column 36,
Line 30, delete "the cold rolled strip" and insert -- the aluminum alloy sheet -- therefor.

Signed and Sealed this

Second Day of April, 2002

*Attest:*

*Attesting Officer*

JAMES E. ROGAN
*Director of the United States Patent and Trademark Office*